US009366453B2

(12) United States Patent
Ogura et al.

(10) Patent No.: US 9,366,453 B2
(45) Date of Patent: Jun. 14, 2016

(54) CONTROL SYSTEM OF AIR CONDITIONING SYSTEM

(75) Inventors: Kazutaka Ogura, Tokyo (JP); Kazuya Tamura, Tokyo (JP); Osamu Noguchi, Tokyo (JP); Yoshito Nakasuji, Tokyo (JP); Yasushi Sato, Aichi (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 974 days.

(21) Appl. No.: 13/575,323

(22) PCT Filed: Feb. 12, 2010

(86) PCT No.: PCT/JP2010/000872

§ 371 (c)(1),
(2), (4) Date: Jul. 26, 2012

(87) PCT Pub. No.: WO2011/099075

PCT Pub. Date: Aug. 18, 2011

(65) Prior Publication Data

US 2012/0296478 A1 Nov. 22, 2012

(51) Int. Cl.

| | |
|---|---|
| ***G06G 7/62*** | (2006.01) |
| ***G05B 11/01*** | (2006.01) |
| ***G05D 23/00*** | (2006.01) |
| ***G05B 15/00*** | (2006.01) |
| ***F24F 11/00*** | (2006.01) |

(52) U.S. Cl.

CPC ..... *F24F 11/0086* (2013.01); *F24F 2011/0091* (2013.01); *F24F 2011/0094* (2013.01)

(58) Field of Classification Search

CPC ..... F24F 11/0086; F24F 2011/0091; F24F 2011/0094

USPC ..... 703/13; 700/276–278, 19

See application file for complete search history.

(56) References Cited

U.S. PATENT DOCUMENTS 6,510,352 B1 * 1/2003 Badavas et al. ..... 700/19
7,546,232 B2 * 6/2009 Brooks et al. ..... 702/183

(Continued)

FOREIGN PATENT DOCUMENTS

JP 02-134572 U 11/1990
JP 04-128941 A 4/1992

(Continued)

OTHER PUBLICATIONS

International Search Report (PCT/ISA/210) issued on Apr. 6, 2010, by the Japanese Patent Office as the International Searching Authority for International Application No. PCT/JP2010/000872.

(Continued)

*Primary Examiner* — Kandasamy Thangavelu
*Assistant Examiner* — Juan Ochoa
(74) *Attorney, Agent, or Firm* — Buchanan Ingersoll & Rooney PC

(57) ABSTRACT

To obtain a control system of an air conditioning system capable of easily confirming a set content of an interlocking control. A simulation device that generates simulation operation information simulating an interlock operation of facility devices based on interlock settings information, a display controller that makes a display device display a layout plan and the simulation operation information in accordance with the display of the facility devices in the layout plan.

15 Claims, 16 Drawing Sheets

(56) References Cited

U.S. PATENT DOCUMENTS

| | | | | |
|---|---|---|---|---|
| 8,315,839 | B2 * | 11/2012 | Rosca et al. | 703/1 |
| 2003/0140637 | A1 | 7/2003 | Masui et al. | |
| 2006/0026972 | A1 | 2/2006 | Masui et al. | |
| 2008/0021685 | A1 * | 1/2008 | Emery et al. | 703/9 |

FOREIGN PATENT DOCUMENTS

| | | | |
|---|---|---|---|
| JP | 9-257297 | A | 9/1997 |
| JP | 10-161731 | A | 6/1998 |
| JP | 11-110455 | A | 4/1999 |
| JP | 11-195186 | A | 7/1999 |
| JP | 2011-350515 | A | 12/2001 |
| JP | 2002-305469 | A | 10/2002 |
| JP | 2005-107854 | A | 4/2005 |
| JP | 2005-122353 | A | 5/2005 |
| JP | 2005122353 | A1 * | 5/2005 |
| JP | 2006-242429 | A | 9/2006 |
| JP | 2006-337021 | A | 12/2006 |
| JP | 2008-249233 | A | 10/2008 |
| JP | 2009-265972 | A | 11/2009 |

OTHER PUBLICATIONS

Office Action (Notification of the First Office Action) issued on Jun. 18, 2014, by the Chinese Patent Office in corresponding Chinese Patent Application No. 201080063506.7, and an English language translation of the Office Action. (17 pages).

Office Action (Notice of Reasons for Rejection) issued on Jan. 7, 2014, by the Japanese Patent Office in corresponding Japanese Patent Application No. 2011-553648, and an English Translation of the Office Action. (7 pages).

Japanese Office Action (Notice of Reasons for Refusal) dated Apr. 23, 2013, issued in corresponding Japanese Patent Application No. JP2011-553648, and English language translation of Office Action. (4 pages).

* cited by examiner

FIG. 3

| Interlock Number | Interlock Source Device | | Interlock Conditions | Interlock Destination Device | | Interlock Operation | Delay Time |
|---|---|---|---|---|---|---|---|
| 1 | Card Key | Address 1-1 1F Card Key | OFF | Air Conditioner | Group (All Groups) | STOP, (ON/OFF) Forbidden, (Operation Mode) Forbidden, (Temperature Setting) Forbidden | |
| 2 | Card Key | Address 1-1 1F Card Key | ON | Air Conditioner | Group (All Groups) | (ON/OFF) Permitted, (Operation Mode) Allowed, (Temperature Setting) Allowed | |
| 3 | Lighting Equipment | Address 4-2 2F Meeting Room A Lighting<br>Address 5-2 2F Meeting Room B Lighting<br>Address 6-2 2F Meeting Room C Lighting | All OFF | Air Conditioner | Group 5 2F Meeting Room A<br>Group 6 2F Meeting Room B<br>Group 7 2F Meeting Room C | Operating, Dry, 28°C, Low Air Volume | |
| 4 | Lighting Equipment | Address 4-2 2F Meeting Room A Lighting<br>Address 5-2 2F Meeting Room B Lighting<br>Address 6-2 2F Meeting Room C Lighting | One or More ON | Air Conditioner | Group 5 2F Meeting Room A<br>Group 6 2F Meeting Room B<br>Group 7 2F Meeting Room C | Operating, Cooling, 28°C, Low Air Volume | |
| 5 | Air Conditioner | Group 5 2F Meeting Room A<br>Group 6 2F Meeting Room B<br>Group 7 2F Meeting Room C | One Group or More Cooling Mode | Ventilating Facility | Group 8 2F Meeting Room Ventilating Device | Operating, Heat Exchange (Ventilating Device), High Air Volume, (ON/OFF) Forbidden | 30 sec |
| 6 | Air Conditioner | Group 5 2F Meeting Room A<br>Group 6 2F Meeting Room B<br>Group 7 2F Meeting Room C | All Other Than Cooling Mode | Ventilating Facility | Group 8 2F Meeting Room Ventilating Device | STOP | 5 min 00 sec |
| 7 | Air Conditioner | Group 1 1F Lobby 1<br>Group 2 1F Lobby 2<br>Group 3 1F Lobby 3<br>Group 4 1F Lobby 4 | One Group or More Defect | Air Conditioner | Group 1 1F Lobby 1<br>Group 2 1F Lobby 2<br>Group 3 1F Lobby 3<br>Group 4 1F Lobby 4 | STOP, (ON/OFF) Forbidden | |
| 8 | Air Conditioner | Group 1 1F Lobby 1<br>Group 2 1F Lobby 2<br>Group 3 1F Lobby 3<br>Group 4 1F Lobby 4 | All Restored | Air Conditioner | Group 1 1F Lobby 1<br>Group 2 1F Lobby 2<br>Group 3 1F Lobby 3<br>Group 4 1F Lobby 4 | (ON/OFF) Allowed | 1 min 00 sec |
| 9 | Card Key | Address 9-1 Drawing Library Card Key | ON | Lighting Equipment | Address 9-2 Drawing Library Lighting | ON | |
| 10 | Card Key | Address 9-1 Drawing Library Card Key | ON | Air Conditioner | Group 9 Drawing Library | Operating, Cooling, 28°C | |
| | ... | | | ... | | | |
| n | | | | | | | |

FIG. 8
(a)
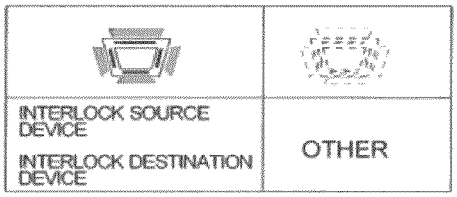
(b)
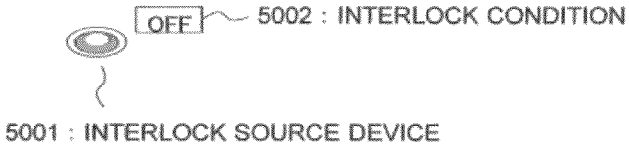
(c)
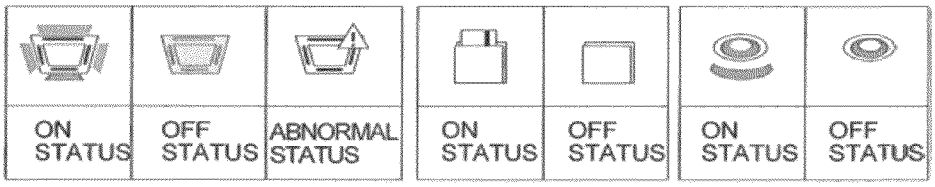
(d)
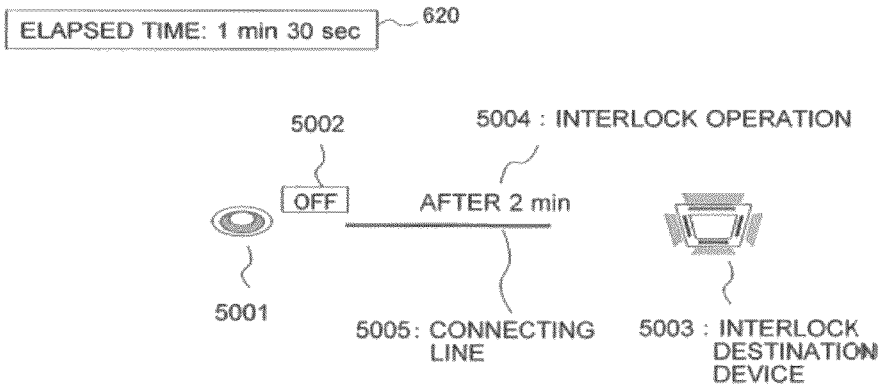

FIG. 9
(a)
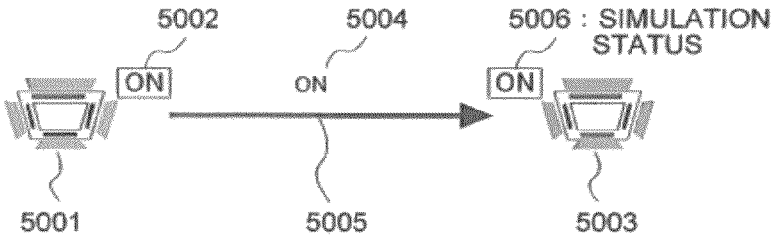
(b)
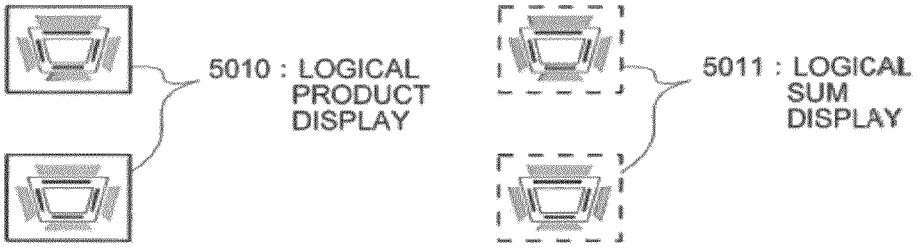

CONTROL SYSTEM OF AIR CONDITIONING SYSTEM

TECHNICAL FIELD

The present invention relates to a control system of an air conditioning system that controls an operation of a plurality of facility devices including at least an air conditioner.

BACKGROUND ART

In the conventional art, there is a system that performs interlocking control that controls, on the basis of preset interlock settings information, an operation of a device by interlocking the device to an operation of another device. For example, an air conditioning system has been proposed "provided with interlocking control information setting means that performs setting of interlocking control information data, storage means that stores interlocking control information data processed by the interlocking control information setting means, and interlocking control execution determination means that determines, on the basis of a transmitted signal, data that satisfies the condition and the valid duration among one or more pieces of interlocking control information data stored in the storage means and that transmits an control command based on the control content to the device subject to control that has been determined to have satisfied the condition and the valid duration" (see Patent Literature 1, for example).

Further, a system that simulates an operation of an air-conditioner has been proposed in which "an air conditioner simulator (100) that is provided with the control means (30) that selects condition control corresponding data (5D) that corresponds to a settings input condition from among control condition data (61) that is stored in the data storage means (60), that executes a simulation program (40) that reflects the operation procedures of the air conditioner based on the settings input condition and the control condition corresponding data (5D), and that outputs the obtained execution result on the display means (70) as displayed data" (see Patent Literature 2, for example).

CITATION LIST

Patent Literature

Patent Literature 1: Japanese Unexamined Patent Application Publication No. 2008-249233 (claim 1)

Patent Literature 2: Japanese Unexamined Patent Application Publication No. 2006-242429 (claim 1)

SUMMARY OF INVENTION

Technical Problem

In the technique of the above Patent Literature 1, when confirming whether a desired interlocking control will be executed by the set content of the interlock setting, visual conformation is required while actually operating the facility devices. As such, there has been a problem in that the set content of the interlocking control cannot be easily confirmed.

In particular, when there is a plurality of devices subject to the interlocking control or when there are combinations of multiple interlocking controls, the interlocking control has to be confirmed under multiple conditions, and it is not easy to operate the device so that they match the conditions.

On the other hand, confirming the content by displaying the interlock setting can be considered. However, it is not easy to confirm whether the interlocking control is a desired one by mere display of information.

For example, if a location of an interlocked device is mistaken, it will not be easy to spot this from a mere list of information.

Further, in the technique of the above Patent Literature 2, although simulation of the operation of the air conditioner can be performed, disadvantageously, simulation of the interlocking control in relation to other facility devices cannot be carried out.

Furthermore, in conventional techniques, there has been a problem that even when, for example, there is a contradiction in the content of the interlock setting or even when there is an incorrect setting such that the interlocking control is repeated infinitely by the interlock, these cannot be detected.

The invention has been made to overcome the above problems, and an object thereof is to obtain a control system of an air conditioning system that is capable of facilitating confirmation of the set content of the interlocking control.

Further, another object is to obtain a control system of an air conditioning system that is capable of simulating an interlock operation based on the interlock settings information without actual operation of the facility devices.

Furthermore, still another object is to obtain a control system of the air-conditioning system that is capable of detecting an incorrect setting in the content of the interlock setting.

Solution to Problem

A control system of an air conditioning system according to the invention in one that controls operations of a plurality of facility devices including at least an air conditioner, the control system of an air conditioning system including:

a storage device that stores a single or a plurality of pieces of interlock settings information that is information for interlockingly control the facility devices and information on a layout plan that indicates the arrangement of the facility devices in a conditioned space;

a simulation device that generates simulation operation information in which an interlock operation of the facility devices is simulated on the basis of the interlock settings information;

a display device; and a display controller that makes the display device display the layout plan, and that makes the display device display the simulation operation information in accordance with the display of the facility devices in the layout plan.

Advantageous Effects of Invention

The invention generates simulation operation information that has simulated an interlock operation of facility devices on the basis of interlock settings information and displays the interlocking settings information in accordance with a display of the facility devices in a layout plan. Accordingly, it will be possible to easily confirm a set content of an interlocking control.

BRIEF DESCRIPTION OF DRAWINGS

FIG. 3 is a diagram illustrating a data configuration of the interlock settings information according to Embodiment 1.

FIG. 8 is a diagram illustrating a display content of an interlocking simulation according to Embodiment 1.

FIG. 9 is a diagram illustrating another display content of an interlocking simulation according to Embodiment 1.

DESCRIPTION OF EMBODIMENTS

Embodiment 1

Figure 1:
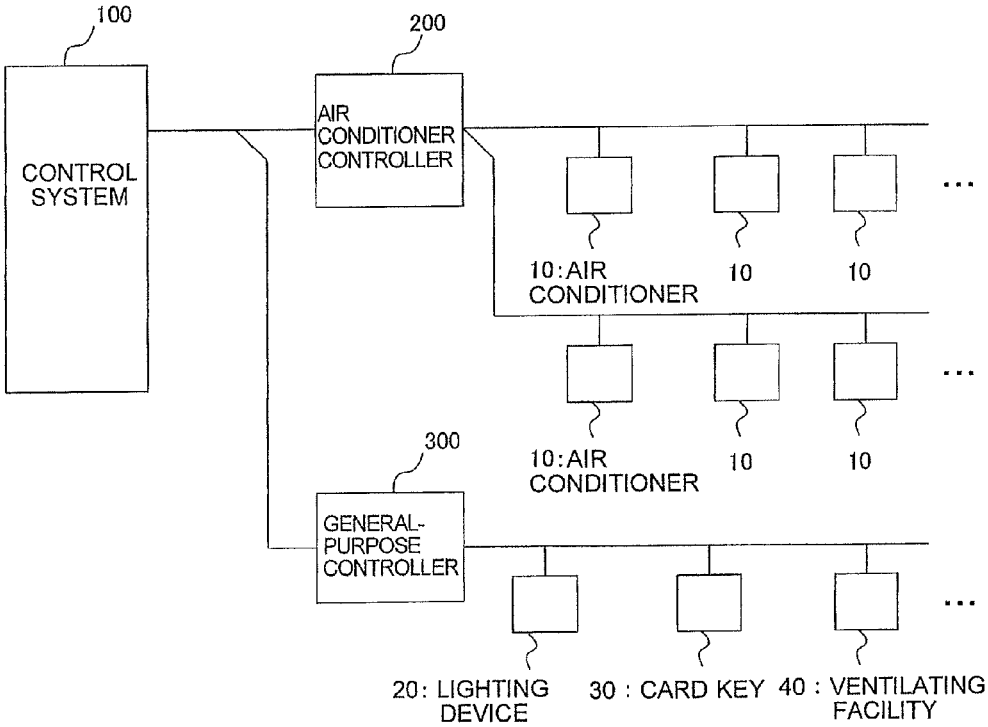
FIG. 1 is a diagram illustrating a configuration of an air conditioning system according to Embodiment 1.

FIG. 1 is a diagram illustrating a configuration of an air conditioning system according to Embodiment 1.

Referring to FIG. 1, the air conditioning system includes a control system 100, an air conditioner controller 200, a general-purpose controller 300, air conditioners 10, lighting device 20, card key 30, and a ventilating facility 40.

Note that the "control system 100" corresponds to a "control system of an air conditioning system" of the invention.

Further, the "air conditioners 10", the "lighting device 20", the "card key 30", and the "ventilating facility 40" each correspond to a "facility device" in the invention.

Note that in the subsequent description, when the "air conditioners 10", the "lighting device 20", the "card key 30", and the "ventilating facility 40" are not distinguished, they may simply be referred to as "facility devices".

Note that the "facility devices" in the invention are not limited to the above, and any device in any number can be used.

The control system 100 is connected with a communication line to a single or a plurality of air conditioners 10 through the air conditioner controller 200.

The air conditioner controller 200 controls the operation of each air conditioner 10 on the basis of a control signal from the control system 100 or a control signal from a remote control or the like of the air conditioner 10.

Each air conditioner 10 air conditions a conditioned space in which it is disposed.

The control system 100 is connected with a communication line to the lighting device 20, the card key 30, and the ventilating facility 40 through the general-purpose controller 300.

The general-purpose controller 300 controls the operation of each facility device on the basis of a control signal from the control system 100 or an actuating signal of the like from each facility device.

With such a configuration, the control system 100 performs integrated control of each facility device.

Further, the control system 100 performs interlock operation of each facility device on the basis of interlock settings information described later.

Furthermore, the control system 100 of Embodiment 1 is capable of displaying a result of an interlock operation based on the interlock settings information without actual operation of each facility device. Next, the configuration of the control system 100 that operates as such will be described.

Figure 2:
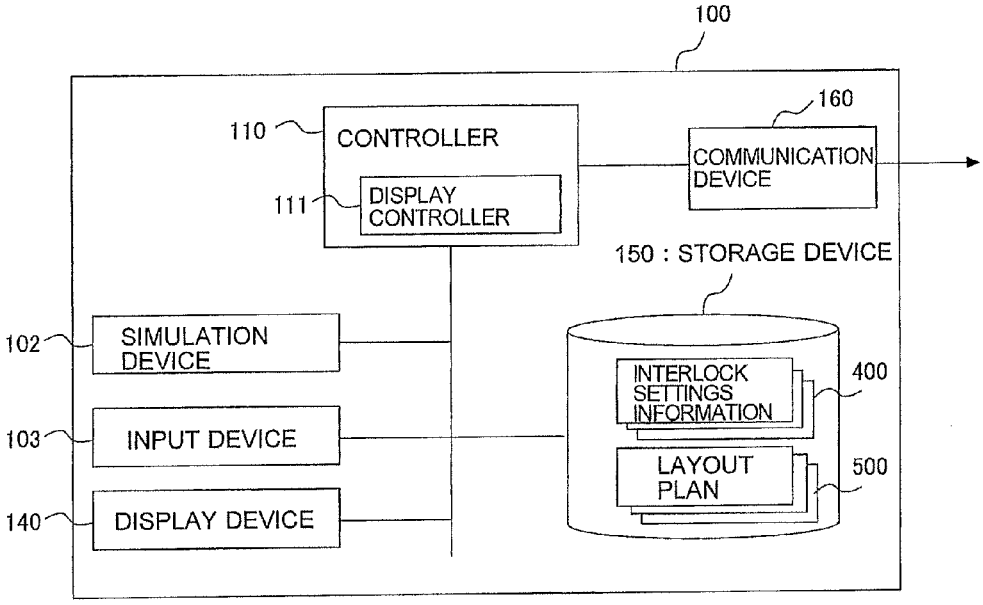
FIG. 2 is a diagram illustrating a configuration of a control system 100 according to Embodiment 1.

FIG. 2 is a diagram illustrating a configuration of the control system 100 according to Embodiment 1.

As shown in FIG. 2, the control system 100 includes a controller 110, a display controller 111, a simulation device 120, an input device 130, a display device 140, a storage device 150, and a communication device 160.

The controller 110 controls each facility device on the basis of the actuating signal or the like from each facility device that the communication device 160 has received and the interlock settings information or the like.

The display controller 111 is provided in, for example, the controller 110.

The display controller 111 makes the display device 140 display a layout plan, as well as making simulation operation information be displayed corresponding to the display of the facility device in the layout plan. Details will be described later.

The simulation device 120 generates the simulation operation information that has simulated the interlock operation of the facility devices on the basis of the interlock settings information described later.

The input device 130 is an interface for a user to input the control of each facility device. The input device 130 is also an interface for inputting information on the control that makes simulation of the operation of each facility device be performed and information on the elapse of time to simulate the control, when the simulation of the interlocking control is performed.

The display device 140 displays the layout plan, various menu screens, and a control input screen according to instructions from the display controller 111.

The storage device 150 stores a single or a plurality of pieces of interlock settings information 400 that is information for controlling the facility devices in an interlocked manner and stores information on the layout plan 500 that illustrates the arrangement of the facility devices in the conditioned space. Details will be described later.

Note that the controller 110, the display controller 111, and the simulation device 120 may be built as hardware such as a circuit device that implements these functions or may be built as software that implements these functions on an arithmetic unit such as a microcomputer or a CPU.

The input device 130 may be constituted by a touch panel, a key board, a mouse, and the like.

The display device 140 may be constituted by an arbitrary device such as a liquid crystal display (LCD).

The storage device 150 may be constituted by an arbitrary memory medium such as a hard disk drive (HDD) or a flash memory.

The communication device 160 may be constituted by an arbitrary network interface such as a LAN interface.

The configuration of the control system 100 of Embodiment 1 has been described above.

Next, the interlock settings information 400 and the layout plan 500 that are stored in the storage device 150 will be described.

[Interlock Settings Information]

FIG. 3 is a diagram illustrating a data configuration of the interlock settings information according to Embodiment 1.

As shown in FIG. 3, the interlock settings information 400 includes information on at least an interlock source device, an interlock condition, an interlock destination device, and the interlock operation.

Note that in addition to this, as shown in FIG. 3, an interlock number identifying the interlock settings information and delay time may be provided.

Further, information of an interlock name indicating a content of an interlocking control may be allocated to each interlock number.

The interlock source device is information identifying the facility device set with the interlock condition.

The interlock condition is information on the condition to implement the interlocking control.

The interlock destination device is information identifying the facility device subject to the interlocking control.

The interlock operation is information specifying the operation to operate the interlock destination device when the interlock source device satisfies the interlock condition.

Delay time is information that sets the time period until the interlock operation is performed after the interlock condition is met.

Referring to FIG. 3, description will be made in detail.

In the exemplary setting, there are, broadly, four types of settings.

Interlock numbers 1 and 2 control the air conditioning of the entire building as a conditioned space with an administrative card key.

Interlocking numbers 3 to 6 control the 2F meeting room as a conditioned space to become a comfortable environment while achieving energy saving.

Interlock numbers 7 and 8 control the relevant facility device to stop when an abnormality occurs in the facility device.

Interlock numbers 9 and 10 control the facility device provided in the drawing library that requires a card key 30 to enter.

(Interlock Number 1)

As shown in FIG. 3, the set content of interlock number 1 is as follows.

Information of the interlock source device is "Address 1-1•1F Card Key" that is information identifying the 1F administrative card key of the building.

Information of the interlock condition is "OFF" indicating a status in which the card key is taken out.

Information of the interlock destination device is "Group (All Groups)" designating all of the air conditioners.

Information of the interlock operation is "STOP, (ON/OFF) Forbidden, (Operation Mode Forbidden), (Temperature Setting) Forbidden" which designates an operation suspending the operation of the air conditioners and an operation forbidding all control from the remote control.

Under such a setting, when the 1F administrative card key of the building is taken out, all of the air conditioners are suspended and the control of the remote control is forbidden.

Similarly, the contents of the interlock operation according to the settings shown in FIG. 3 will be described below.

(Interlock Number 2)

This setting allows control of hand remote controls of all of the air conditioners when the 1F administrative card key of the building is inserted.

(Interlock Number 3)

This setting turns the operation status of the air conditioners to dry when lights in all of the 2F meeting room A, meeting room B, and meeting room C are turned off.

(Interlock Number 4)

This setting turns the operation status of the air conditioners to cooling when the lights in either of the 2F meeting room A, meeting room B, and meeting room C is turned on.

(Interlock Number 5)

This setting operates the ventilation system of the meeting rooms, 30 seconds after either of the 2F meeting room A, meeting room B, and meeting room C has been turned to cooling.

Note that there is a case in which the interlock condition of interlock number 5 is met by the execution of the interlock number 4, and interlock number 5 is executed in succession with the operation of interlock number 4.

Hereinafter, as above, an operation in which an interlocking control is started by meeting its interlock condition owing to a result of another interlock control will be referred to as "link". An operation in which an interlocking control is linked will be described later.

When interlock number 5 is linked with interlock number 4, the ventilation system is operated 30 seconds after the operating status of the air conditioners is turned to cooling with the turning on of either of the lights in the 2F meeting room A, meeting room B, and meeting room C.

(Interlock Number 6)

This setting turns off the ventilation system of the meeting rooms five minutes after either of the air conditioners in the 2F meeting room A, meeting room B, and meeting room C is turned to anything but cooling.

When interlock number 6 is linked with interlock number 3, the ventilation system is stopped 5 minutes after the operating status of the air conditioners is turned to drying with the turning off of all of the lights in the 2F meeting room A, meeting room B, and meeting room C.

(Interlock Number 7)

This setting stops all of the air conditioners in the 1F lobby and forbids control of the hand remote control when either of the air conditioners in the 1F lobby is in an abnormal status.

(Interlock Number 8)

This setting allows control of the hand remote control of all of the air conditioners in the 1F lobby one minute after all of the air conditioners in the 1F lobby has been restored from the abnormality.

(Interlock Number 9)

This setting turns on the light of the drawing library when a card key of the entrance of the drawing library is inserted.

(Interlock Number 10)

This setting turns the air conditioner of the drawing library to cooling when the card key of the entrance of the drawing library is inserted.

That is, the interlock numbers 9 and 10 are executed at the same time.

[Layout Plan 500]

Figure 4:
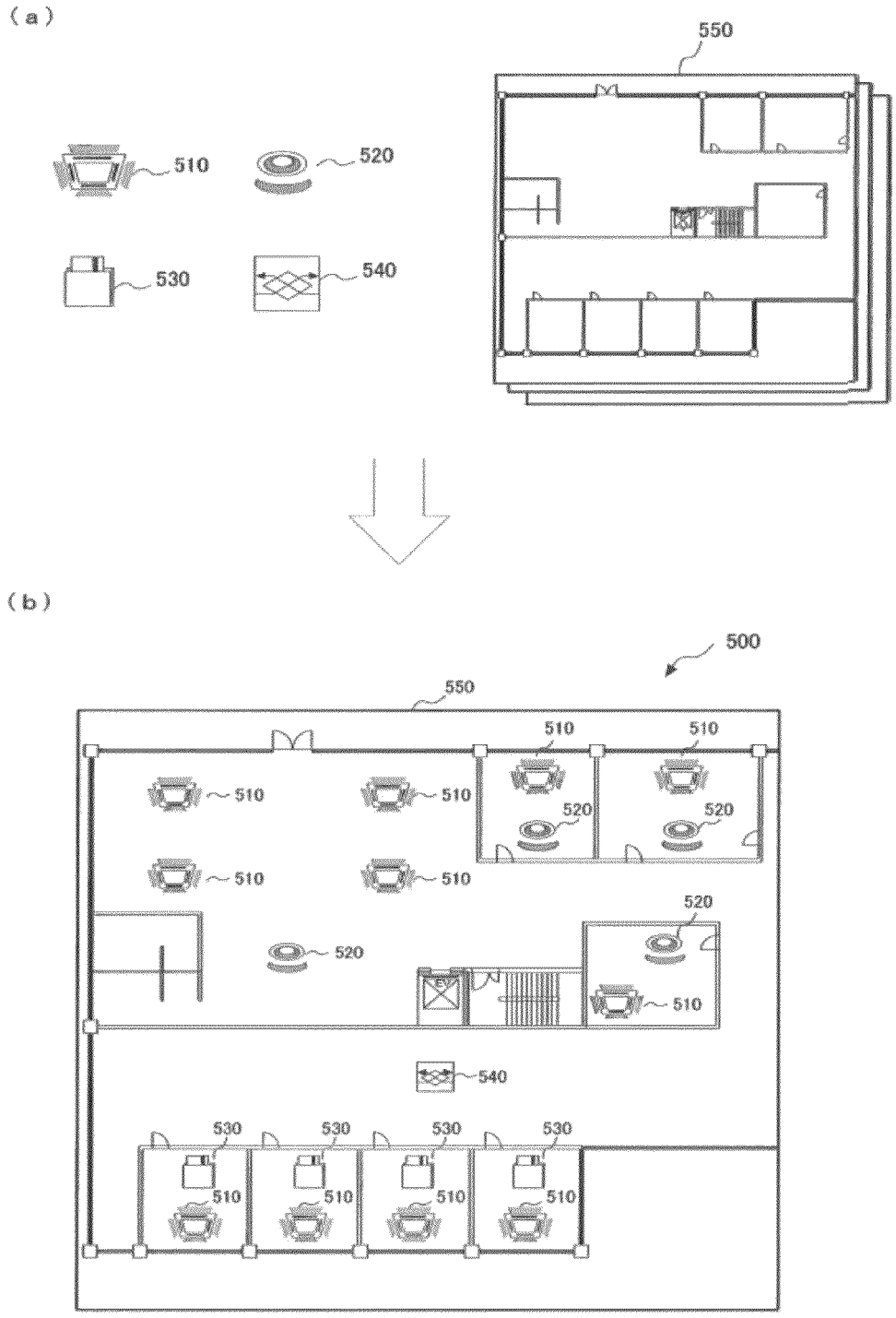
FIG. 4 is a diagram illustrating a configuration of a layout plan according to Embodiment 1.

FIG. 4 is a diagram illustrating a configuration of a layout plan according to Embodiment 1.

As illustrated in FIG. 4(*a*), the storage device 150 is prestored with information of an air conditioner icon 510, a lighting device icon 520, a card key icon 530, a ventilating facility icon 540, and floor information 550.

The air conditioner icon 510 is an illustration indicating the air conditioner 10. The lighting device icon 520 is an illustration indicating the lighting device 20. The card key icon 530 is an illustration indicating the card key 30. The ventilating facility icon 540 is an illustration indicating the ventilating facility 40.

Further, the floor information 550 is a layout chart (plan view) of the conditioned space where the facility devices are disposed. Note that the floor information 550 may be provided in plural numbers depending on the largeness of the conditioned space or the number of floors.

Note that the floor information 550 is not limited to the plan view. An arbitrary view such as a bird's-eye view may be used.

As illustrated in FIG. 4(*b*), the layout plan 500 illustrates an arrangement of the facility devices in the conditioned space by compositing the floor information 550 and each illustration (510 to 540) indicating the facility device.

For example, the layout plan 500 is generated on the basis of prestored information of the relation between coordinate information of the conditioned space illustrated by the floor information 550, and the type of the facility device and coordinate information of the position of the facility device.

By generating the layout plan 500 as such, even when the number of facility devices is varied and the positions of the facility devices are changed due to repair work, for example, modification of the layout plan 500 is facilitated.

Note that although a case in which the floor information 550 and the illustration indicating each facility devices are composited will be described, the invention is not limited to this case. A drawing displaying, from the first, the facility devices on the layout illustrating the conditioned space may be used.

Next, a simulated operation (hereinafter, may be referred to as an "interlocking simulation") of the interlocking control based on the interlock settings information 400 will be described.

[Initial Display]

Figure 5:
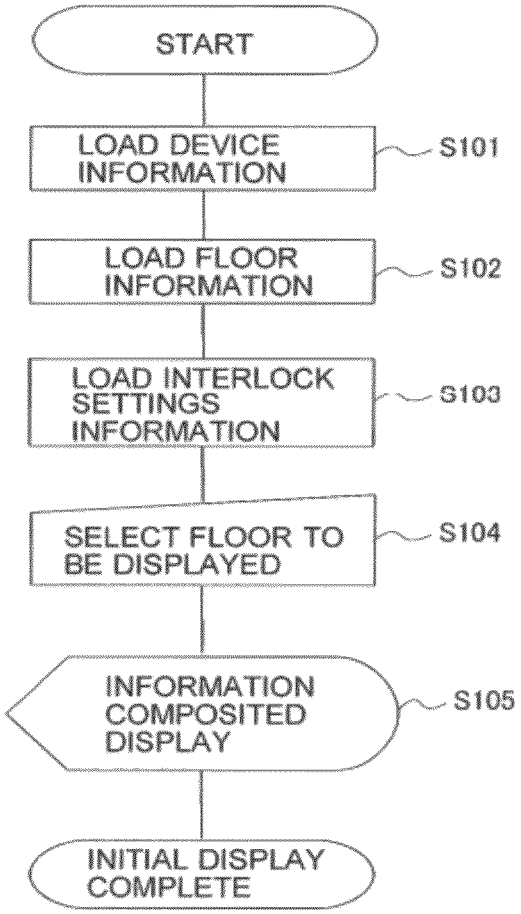
FIG. 5 is a flowchart illustrating an initial display operation according to Embodiment 1.

FIG. 5 is a flowchart illustrating an initial display operation according to Embodiment 1.

Figure 6:
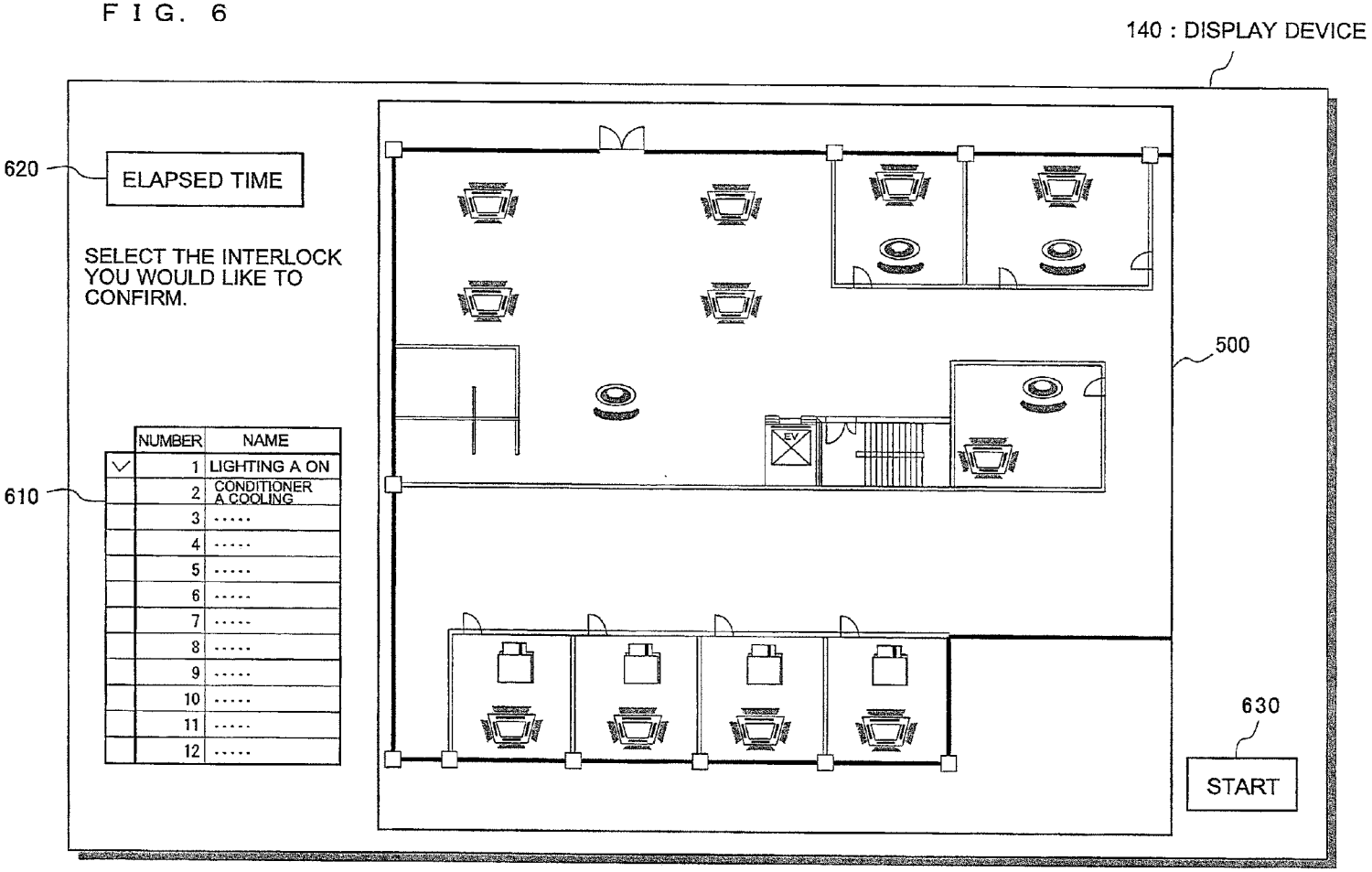
FIG. 6 is a diagram illustrating an initial display screen according to Embodiment 1.

FIG. 6 is a diagram illustrating an initial display screen according to Embodiment 1.

Referring to FIG. 6, description will be made below based on each step in FIG. 5.

(S101)

The display controller 111 loads each illustration (510 to 540) illustrating the facility device, which is stored in the storage device 150.

(S102)

The display controller 111 loads the floor information 550 that is stored in the storage device 150.

(S103)

The display controller 111 loads the interlock settings information 400 that is stored in the storage device 150.

(S104)

Next, the user inputs a control that selects the floor to be displayed. Note that this step can be omitted and a predetermined floor may be selected in advance.

(S105)

The display controller 111 generates, on the basis of the loaded information, the layout plan 500 that illustrates the arrangement of the facility devices in the selected floor, and makes the display device 140 display the layout plan 500 and list information (an interlock list 610) of the interlock settings information 400 (FIG. 6).

Further, in addition to this, an elapsed time indicator 620, which indicates an elapsed time of the interlocking simulation operation, and a start button 630 of the interlocking simulation operation are displayed (FIG. 6).

Note that this initial display is executed, for example, when the control system 100 is started up or by a control of the user.

Note that the floor selection described in step S104 may be carried out at an arbitrary timing. When switching of the displayed floor is carried out, step S105 is repeated against the selected floor.

[Interlock Display]

Figure 7:
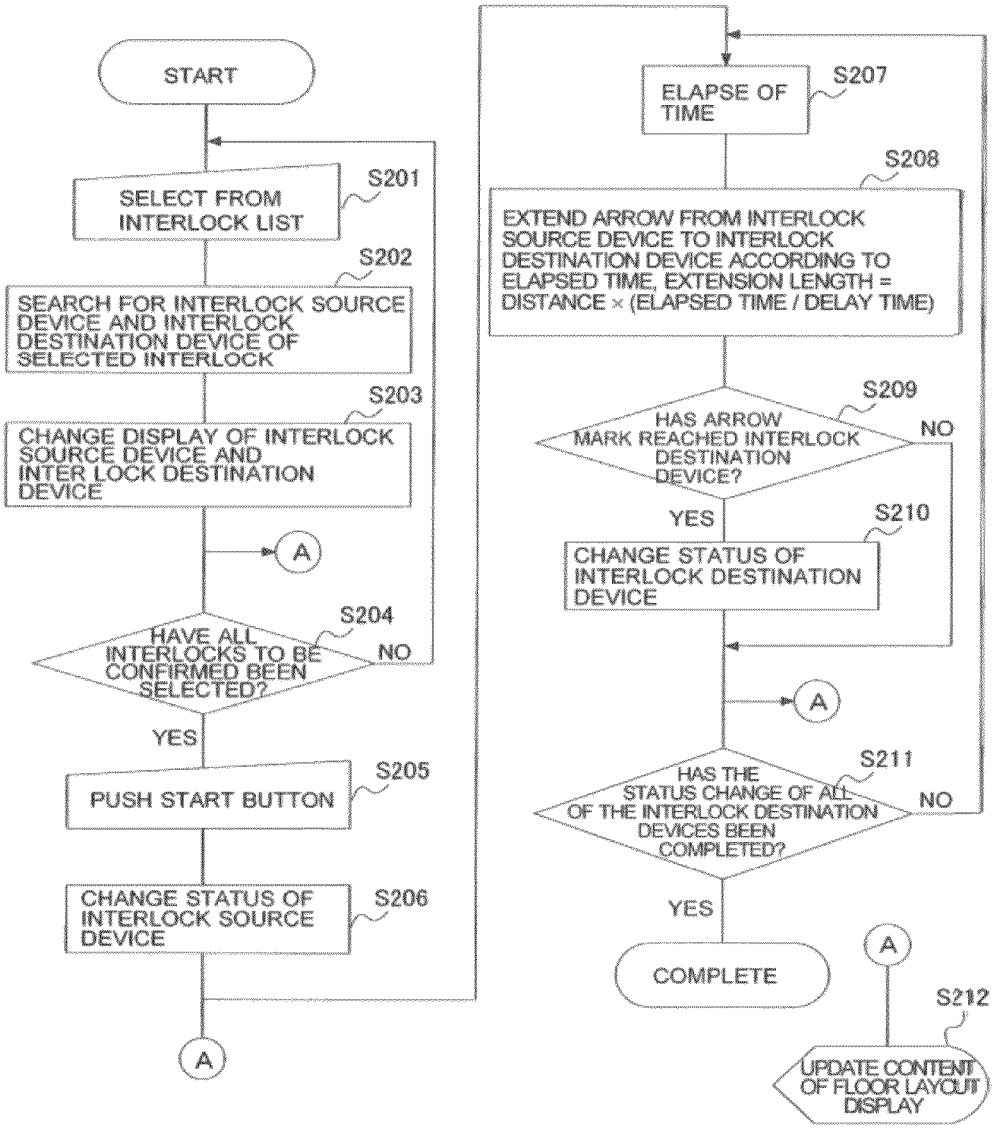
FIG. 7 is a flowchart illustrating an operation of an interlocking simulation according to Embodiment 1.

FIG. 7 is a flowchart illustrating an operation of the interlocking simulation according to Embodiment 1.

FIG. 8 and FIG. 9 are diagrams illustrating a display content of the interlocking simulation according to Embodiment 1.

Figure 10:
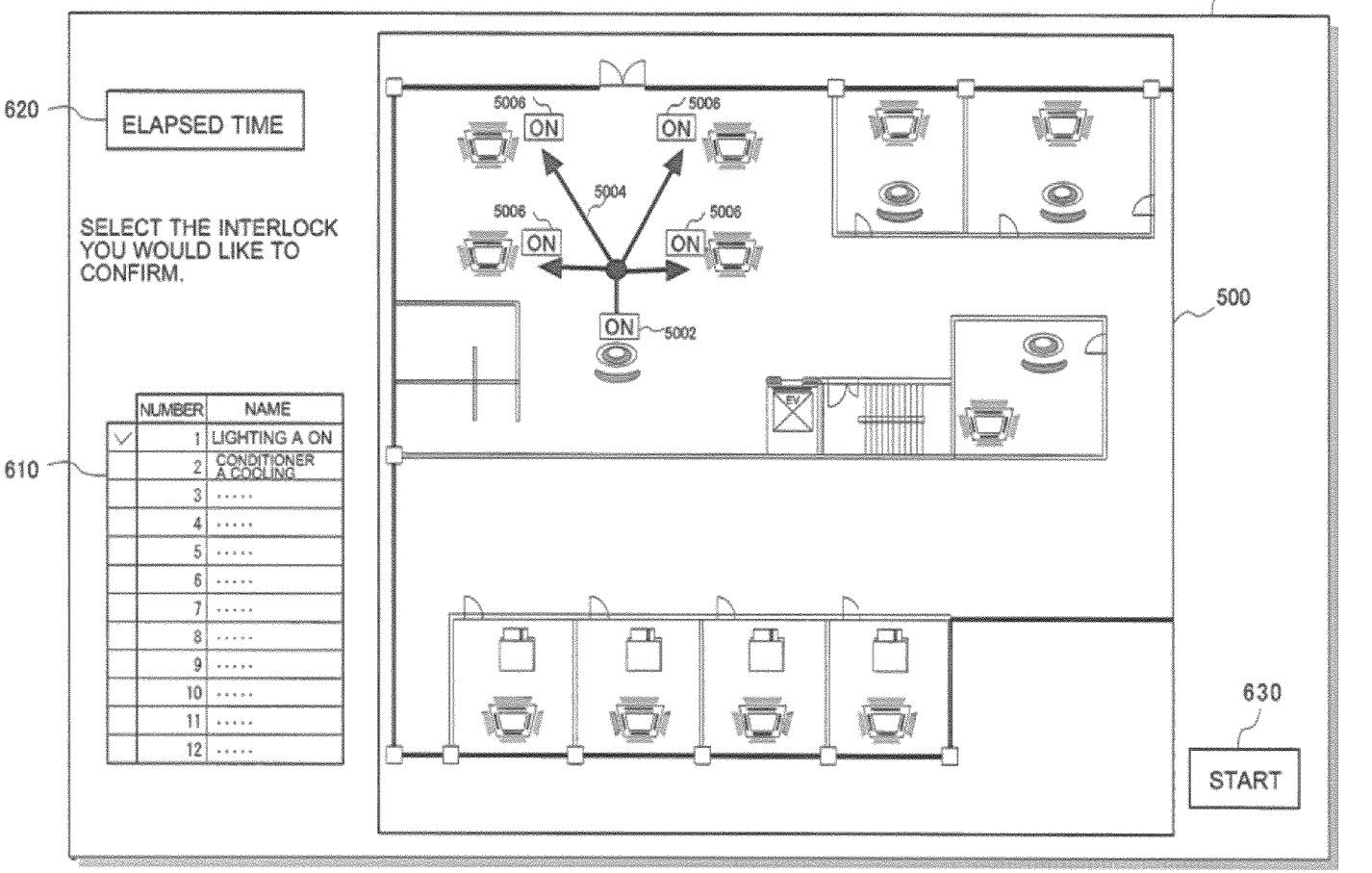
FIG. 10 is a diagram illustrating a result display screen of an interlocking simulation according to Embodiment 1.

FIG. 10 is a diagram illustrating a result display screen of an interlocking simulation according to Embodiment 1.

Referring to FIGS. 8 to 10, description will be made below based on each step in FIG. 7.

(S201)

First, the user selects a single or a plurality of interlock numbers that is to execute the interlocking simulation from the interlock list 610 displayed on the initial display screen.

(S202)

The display controller 111 searches for the interlock source device and the interlock destination device of the selected interlock number(s) from among the facility devices displayed on the currently displayed layout plan 500.

(S203)

The display controller 111 updates the information of the layout plan 500 so as to discriminate between the display of the searched interlock source device and the interlock destination device, and the display of other facility devices. The display device 140 updates and displays the screen (S212).

For example, as illustrated in FIG. 8(*a*), the display of the facility devices other than the interlock source device and the interlock destination device are displayed by dotted lines. Note that not limited to the above, the color may be turned pale or the icon may be deleted, for example.

With such a display, the facility device that is related to the interlocking control and its location can be visually understood.

(S204)

Next, the display controller 111 makes a message be displayed that confirms the user whether the selection of the interlock number has been completed.

If a control is performed by the user indicating that the selection has not been completed, the process returns to step S201.

On the other hand, if a control is performed by the user indicating that the selection has been completed, the process proceeds to step S205.

Note that this step S204 may be omitted.

(S205)

The user performs a control that executes the interlocking simulation by controlling the start button 630 or the like.

(S206)

The simulation device 120 starts the interlocking simulation on the basis of the interlock settings information 400 of the interlock number that has been selected in the above step S201.

First, the simulation device 120 generates, as simulation operation information, information simulating an operation status in which the interlock source device has satisfied the interlock condition on the basis of information of the interlock source device and information of the interlock condition of the interlock settings information 400.

For example, in interlock number 3 of FIG. 3, a state in which the operation status of all the lighting devices of the 2F meeting rooms A to C are OFF is generated as the simulation operation information.

Note that if the interlock condition is a logical sum of multiple operation statuses, a simulation may be performed such that an arbitrary operation status satisfies the interlock condition, and a display indicating that the other devices are conditions of the logical sum, which will be described later, may be displayed.

For example, in interlock number 4 of FIG. 3, a state in which the operating status of the lighting device of the 2F meeting room A is OFF is generated as the simulation operation information, and a display may be displayed indicating that the 2F meeting rooms B and C are conditions of the logical sum.

The display controller 111 makes the generated simulation operation information be displayed in accordance with the interlock source devices of the layout plan 500. The display device 140 updates and displays the screen (S212).

For example, as illustrated in FIG. 8(*b*), an interlock condition 5002 that is an operation status simulated by the simulation device is displayed in the vicinity of an interlock source device 5001.

Note that the display of the simulation operation information is not limited to character information but can be any that can identify the operation status.

For example, the display controller 111 may make the display of the associated facility device in the layout plan 500 be changed according to the content of the simulation operation of the interlock source device.

For example, as illustrated in FIG. 8(*c*), each display may be changed according to its status, such as an ON status, an OFF status, and an abnormal status.

(S207)

Next, the simulation device 120 is in a standby state until the delay time of the interlock settings information 400 elapses. Note that if the delay time is not set, this step is omitted.

In step S207, the simulation device 120 may change the time scale of the delay time. For example, the time scale can be increased, such that one second of delay time is converted to one minute of simulation operation. The time scale can also be reduced, such that one minute of delay time is converted to one second of simulation operation.

As such, by changing the time scale of the delay time, if the delay time is short, with the increase of the time scale of the delay time, the interlock operation of each device can be easily confirmed. Further, if the delay time is long, by reducing the time scale, the simulation operation can be performed in a short time.

(S208)

The display controller 111 makes the interlock source device and the interlock destination device in the layout plan 500 be displayed with a line or an arrow connecting therebetween.

At this time, if a delay time is set, the length of the line or the arrow is changed in accordance with the elapse of time.

For example, as illustrated in FIG. 8(*d*), the length of a connecting line 5005 from the interlock source device 5001 to the interlock destination device 5003 is extended with the elapse of time.

For example, the length is changed to a length that is obtained by the following equation: line length=(displayed distance between the interlock source device and the interlock destination device)×(elapsed time/delay time).

Further, as illustrated in FIG. 8(*d*), the elapsed time indicator 620 may display the elapsed time until the present time.

Further, an interlock operation 5004 that indicates the content of the interlock operation and the delay time may be displayed in the vicinity of the connecting line 5005.

With such a display, a standby state due to the delay time can be visually understood.

(S209)

The display controller 111 determines whether the display of the line or the arrow between the interlock source device and the interlock destination device has been completed, and if not, that is, if the delay time has not elapsed, proceeds to step S211.

(S210)

On the other hand, if the connection of the line or the arrow in between the devices has been completed, that is, if the delay time has elapsed, the simulation device 120 generates, as simulation operation information, information simulating an operation status of the interlock destination device on the basis of information of the interlock source device and information of the interlock operation of the interlock settings information 400.

For example, in interlock number 3 of FIG. 3, as simulation operation information, a state is generated in which the operation statuses of the air conditioners of the 2F meeting rooms A to C are operation ON, dry mode, temperature setting 28 degrees C., low air volume.

The display controller 111 makes the generated simulation operation information be displayed in accordance with the interlock destination devices of the layout plan 500. The display device 140 updates and displays the screen (S212).

For example, as illustrated in FIG. 9(*a*), a simulated status 5006 that is an operation status simulated by the simulation device is displayed in the vicinity of an interlock destination device 5003.

Note that the display of the simulation operation information is not limited to character information but can be any that can identify the operation status.

For example, the display controller 111 may make the display of the associated facility device in the layout plan 500 be changed according to the content of the simulation operation of the interlock destination device.

With such an operation, as illustrated in FIG. 9(*a*), the interlock source device 5001 and the interlock destination device 5003 is connected and displayed with the connecting line 5005.

Further, the interlock source device 5001 and the interlock destination device 5003 are displayed in accordance with the simulated operation status.

Furthermore, the interlock condition 5002 is displayed in the vicinity of the interlock source device 5001 and the simulated status 5006 is displayed in the vicinity of the interlock destination device 5003.

Additionally, the interlock operation 5004 is displayed in the vicinity of the connecting line 5005.

Note that the display controller 111 may make at least one of the interlock condition, the interlock source device, the interlock destination device, and the interlock operation be displayed in accordance with the display of the facility devices in the layout plan 500.

With such a display, the operation status and the interlock condition of the facility devices operated by the interlock operation can be visually understood. As such, the user can intuitively recognize the content of the interlocking.

(S211)

The simulation device 102 determines whether the simulation operation of all of the interlock destination devices of the interlock settings information 400 has been completed.

If not completed, the process returns to step S207 and the above steps are repeated.

On the other hand, if all of the simulation operation has been completed, the interlocking simulation operation is completed.

Note that if the numbers of the interlock source devices and the interlock destination devices are different, the line or the arrow connecting the devices may be branched and displayed.

Further, if there is an interlock condition that is a logical product (logical AND) of the operation of multiple facility devices and an interlock condition that is a logical sum (logical OR) of the operation of multiple facility devices, the facility devices that are subject to the interlock condition may be displayed so as to be discriminated.

For example, as illustrated in FIG. 9(*b*), a logical product display 5010 that is constituted by solid lines may be displayed with the device subject to the logical product. Further, a logical sum display 5011 that is constituted by dotted lines may be displayed with the device subject to the logical sum.

With the above operation, as illustrated in FIG. 10, the simulation operation information such as the interlock condition 5002, the simulated status 5006, and the connecting line 5005 is displayed with the facility devices that have performed the interlocking simulation in the layout plan 500 that is displayed in the display device 140.

Note that in step S201, when multiple interlock numbers are selected, the above steps S206 to S212 are performed to each of the interlock settings information 400 corresponding to each interlock number.

Note that when interlocking simulations of multiple pieces of interlock settings information 400 are performed, the multiple interlocking simulations may be performed parallelly.

This will allow multiple interlocking controls based on the multiple pieces of interlock settings information 400 to be simulated at the same time.

In this case, in accordance with the interlock number, the color and line type of each connecting line 5005 may be changed so as to distinguish the simulated interlock settings information 400.

As above, in Embodiment 1, simulation operation information simulating an interlock operation of facility devices based on interlock settings information 400 is generated, a layout plan 500 is displayed on a display device 140, and the simulation operation information is displayed in accordance with the display of the facility devices in the layout plan 500.

Accordingly, an interlock operation based on the interlock settings information 400 can be simulated without actual operation of the facility devices.

Further, it will be possible to understand the content of the interlocking simulation operation in accordance with the display of the facility devices in the layout plan 500, and, thus, it will be possible to easily confirm the set content of the interlocking control.

Further, at least one of the interlock condition, the interlock source device, the interlock destination device, and the interlock operation is displayed in accordance with the display of the facility devices in the layout plan 500.

Accordingly, it will be possible to understand the content of the interlock settings information 400 of the facility devices in accordance with the display of the facility devices in the layout plan 500, and, thus, it will be possible to easily confirm the set content of the interlocking control.

Further, the display of the facility devices in the layout plan 500 is changed according to the content of the simulation operation of the facility devices.

Accordingly, the set content of the interlocking control can be visually understood, and it will be possible to easily confirm the set content of the interlocking control.

Furthermore, among the facility devices in the layout plan 500, the facility devices whose interlock operation has been simulated are connected and displayed with a line of an arrow in between.

Accordingly, the set content of the interlocking control can be visually understood, and it will be possible to easily confirm the set content of the interlocking control.

Additionally, the simulation operation information is generated with the time scale of the delayed time changed, and the displays of the facility devices in the layout plan 500 are changed in accordance with the contents of the simulation operation of the facility devices that are based on the simulation operation information.

Accordingly, if the delay time is short, with the increase of the time scale of the delay time, the interlock operation of each device can be easily confirmed. Further, if the delay time is long, by reducing the time scale, the simulation operation can be performed in a short time. Thus, it will be possible to easily confirm the set content of the interlocking control.

Additionally, among the facility devices in the layout plan 500, the interlock source device and the interlock destination device are connected and displayed with a line or an arrow in between, and the display of the line or the arrow is changed in accordance with the delayed time.

Accordingly, when confirming the interlock that is set with a delay time, confirmation can be made whether the interlock will be performed as scheduled while setting the time scale. Thus, it will be possible to easily confirm the set content of the interlocking control.

Embodiment 2

In above Embodiment 1, the interlocking simulation is performed to each of the selected interlock settings information.

In Embodiment 2, in addition to the operation of above Embodiment 1, an operation (link) in which a different interlock condition of the interlock settings information is satisfied by a result of an interlocking control and in which an interlocking control is started will be described.

Note that the configuration of Embodiment 2 is the same as that of Embodiment 1 and same portions will be referred to with the same reference numerals.

Figure 11:
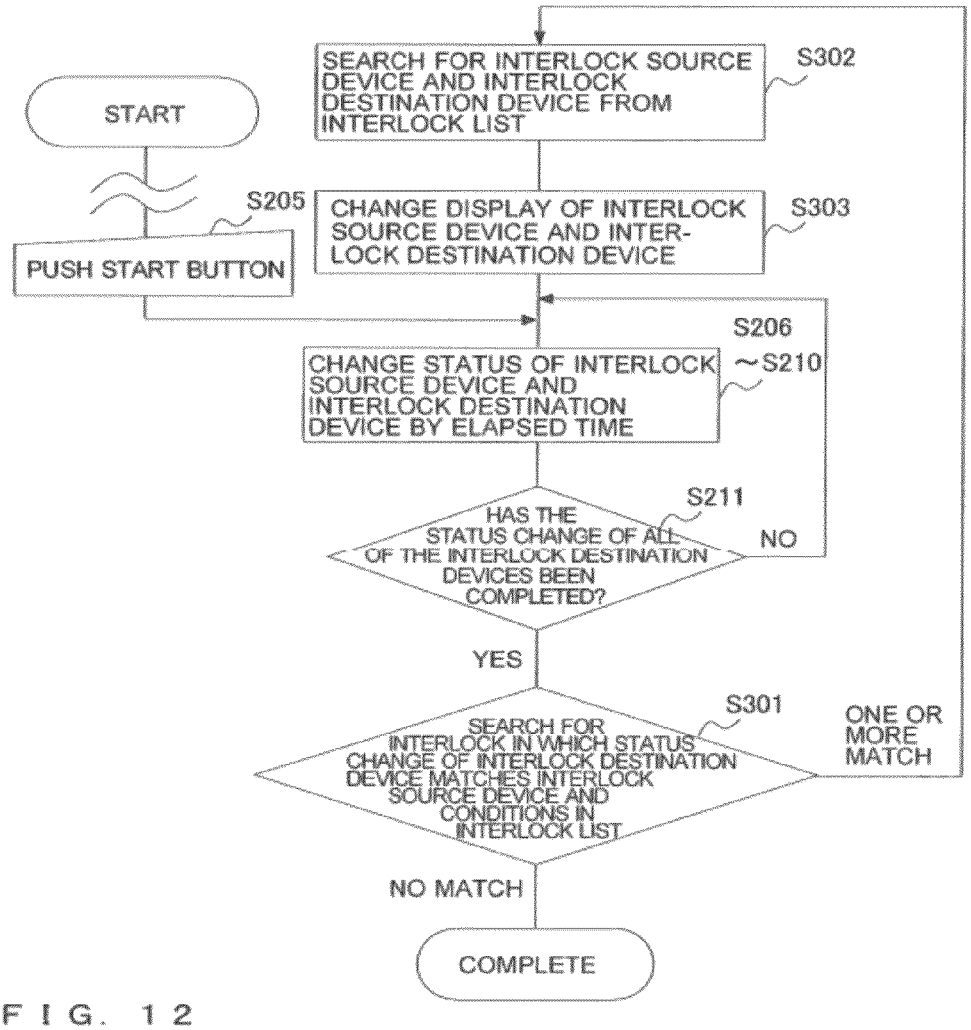
FIG. 11 is a flowchart illustrating an operation of an interlocking simulation according to Embodiment 2.

FIG. 11 is a flowchart illustrating an operation of an interlocking simulation according to Embodiment 2.

Figure 12:
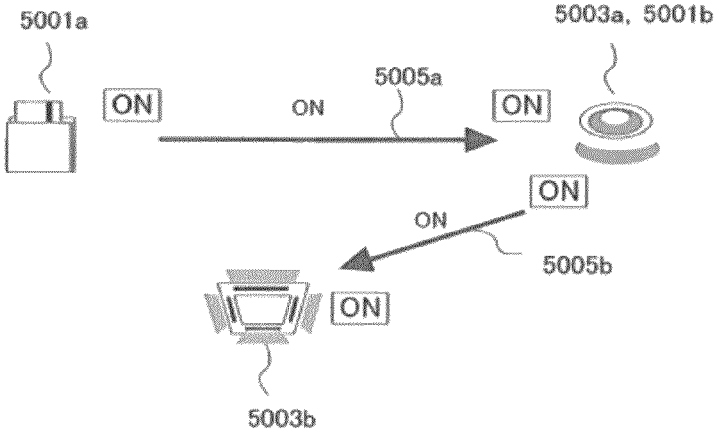
FIG. 12 is a diagram illustrating a display content of an interlocking simulation according to Embodiment 2.

FIG. 12 is a diagram illustrating a display content of the interlocking simulation according to Embodiment 2.

Referring to FIG. 12, description will be made below based on each step in FIG. 11.

Note that the operation same as above Embodiment 1 (FIG. 7) will be denoted with the same reference numeral and description will be omitted.

(S205)

After a single or a plurality of interlock numbers are selected with the same operation as steps S201 to S204 of above Embodiment 1, in step S205, the start button 630 or the like is controlled and the interlocking simulation is started.

(S206 to S210)

With the same operation as that of above Embodiment 1, the interlocking simulation of the selected interlock number(s) is performed and a process changing the status of the interlock source device and the interlock destination device is performed.

(S211)

With the same operation as that of above Embodiment 1, it is determined whether the simulation operation of all of the interlock destination devices of the interlock settings information 400 of the selected interlock number(s) has been completed. If not completed, the above steps are repeated.

(S301)

On the other hand, if all of the simulation operations have been completed, the simulation device 120 searches if there is any or some facility device after simulation of the interlock operation with an operation status that matches the interlock source device and the interlock condition of either of the interlock settings information 400.

If there is no matching interlock settings information 400, the interlocking simulation is completed.

(S302)

On the other hand, if there is one or more pieces of matching interlock settings information 400, each matching interlock settings information 400 (hereinafter, may be referred to as "linking interlock settings information 400") performs an interlocking simulation.

First, the display controller 111 searches for the interlock source device and the interlock destination device of the linking interlock settings information 400 from among the facility devices displayed on the currently displayed layout plan 500.

(S303)

The display controller 111 updates the information of the layout plan 500 so as to discriminate between the display of the searched interlock source device and the interlock destination device, and the display of other facility devices. The display device 140 updates and displays the screen. The discriminating method is the same as that of above Embodiment 1.

(S206 to S210)

The interlocking simulation of the linking interlock settings information 400 is performed with the same operation of step S206 to S210 of above Embodiment 1, and the process changing the status of the interlock source device and the interlock destination device is performed.

Note that at this time, the simulation operation of the linking interlock settings information 400 may be discriminated with the preceding simulation operation by changing the color and line types of the connecting line 5005.

(S211)

With the same operation as that of above Embodiment 1, it is determined whether the simulation operation of all of the interlock destination devices of the linking interlock settings information 400 have been completed.

If not completed, the above steps S206 to 210 are repeated.

If all of the simulation operations have been completed, operations of the above step S301 and after is repeated, and if there is no linking interlock settings information 400, the interlocking simulation operation is completed.

The above will enable simulation of the interlock operation of the linking interlock settings information 400 and display of the operation status.

For example, as illustrated in FIG. 12, on the basis of the selected interlock settings information 400, a status of an interlock destination device 5003*a* becomes ON by interlocking with an ON status of an interlock source device 5001*a*. With this, the interlock condition of an interlock source device 5001*b* of the linking interlock settings information 400 is satisfied, and a status of an interlock destination device 5003*b* becomes ON by an interlocking control.

Note that when interlocking simulations of multiple pieces of interlock settings information 400 are performed parallelly, determination is performed whether there is linking interlock settings information 400 with above step S301, each time the status of an interlock destination device is changed.

As above, in Embodiment 2, simulation operation information is generated on the basis of arbitrary interlock settings information among multiple pieces of interlock settings information, and, on the basis of the operation status of the facility device based on the generated simulation operation information and on the basis of other interlock settings information, simulation operation information that has simulated the interlock operations of facility devices are generated. Further, each piece of simulation operation information is displayed in accordance with the display of the facility devices in the layout plan 500.

Accordingly, when an interlocking simulation of arbitrary interlock settings information 400 is performed, and when another interlock condition of another interlock settings information 400 is satisfied, it will be possible to simulate an interlocking control that has contents of multiple pieces of interlock settings information 400 relating to each other. Thus, it will be possible to easily confirm the set content of the interlocking control.

Furthermore, an interlock operation of facility devices is simulated on the basis of arbitrary interlock settings information among multiple pieces of interlock settings information, and if the operation status of the simulated facility device satisfies an interlock condition of another interlock settings information, the simulation of the interlock operation of the facility devices on the basis of the interlock settings information is repeated.

Accordingly, it will be possible to perform an interlocking simulation of the linking interlock settings information 400. Thus, it will be possible to easily confirm the set content of the interlocking control.

Embodiment 3

In above Embodiment 1, an interlocking simulation is performed by simulating an operation status that satisfies the interlock condition of the selected interlock settings information 400.

In Embodiment 3, after simulating an operation of a facility device on the basis of a control that has been input from the input device 103, an interlocking simulation is performed on the basis of the operation status of the simulated facility device and the interlock settings information.

Note that the configuration of Embodiment 3 is the same as that of Embodiment 1 and same portions will be referred to with the same reference numerals.

Figure 13:
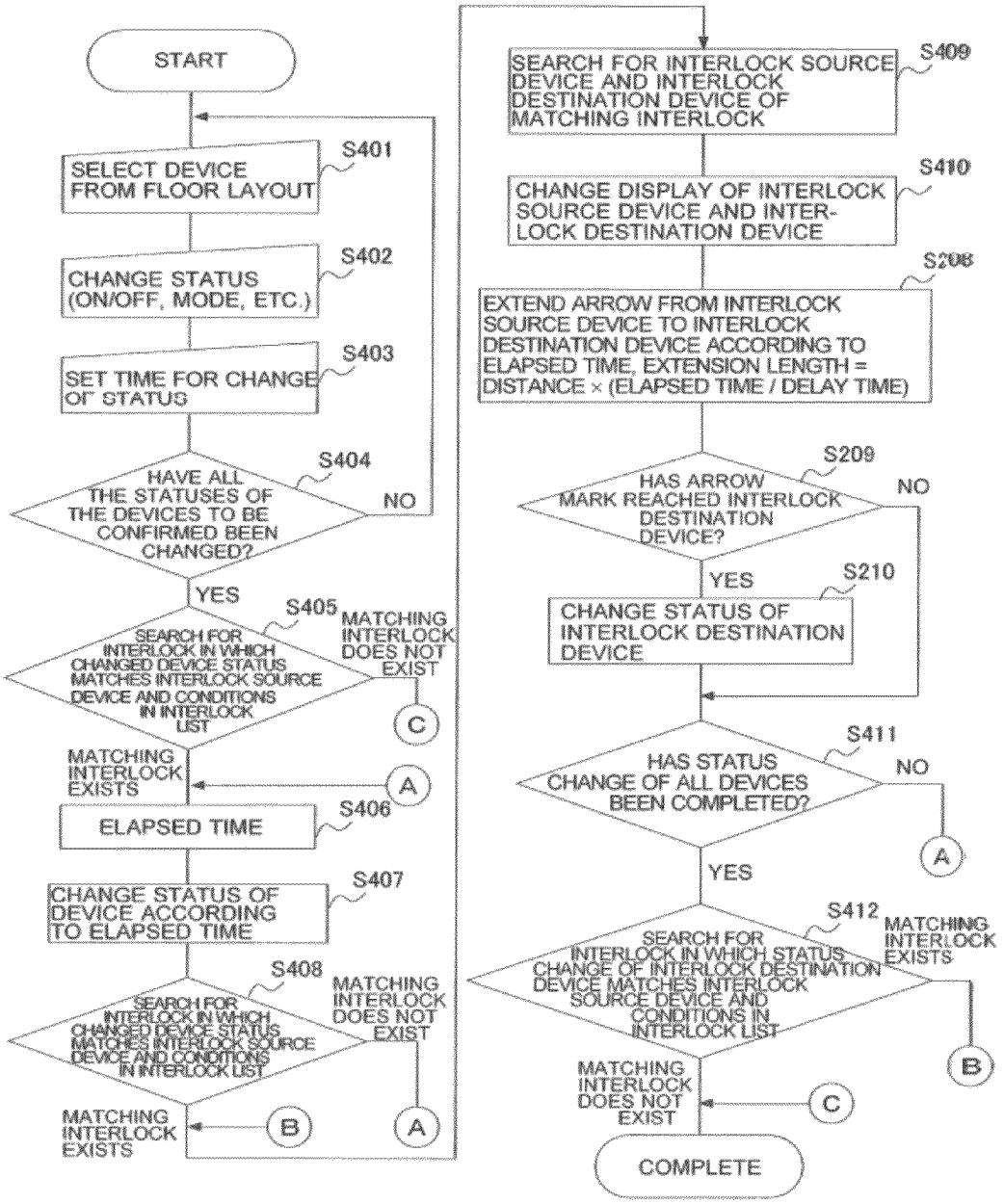
FIG. 13 is a flowchart illustrating an operation of an interlocking simulation according to Embodiment 3.

FIG. 13 is a flowchart illustrating an operation of an interlocking simulation according to Embodiment 3.

Figure 14:
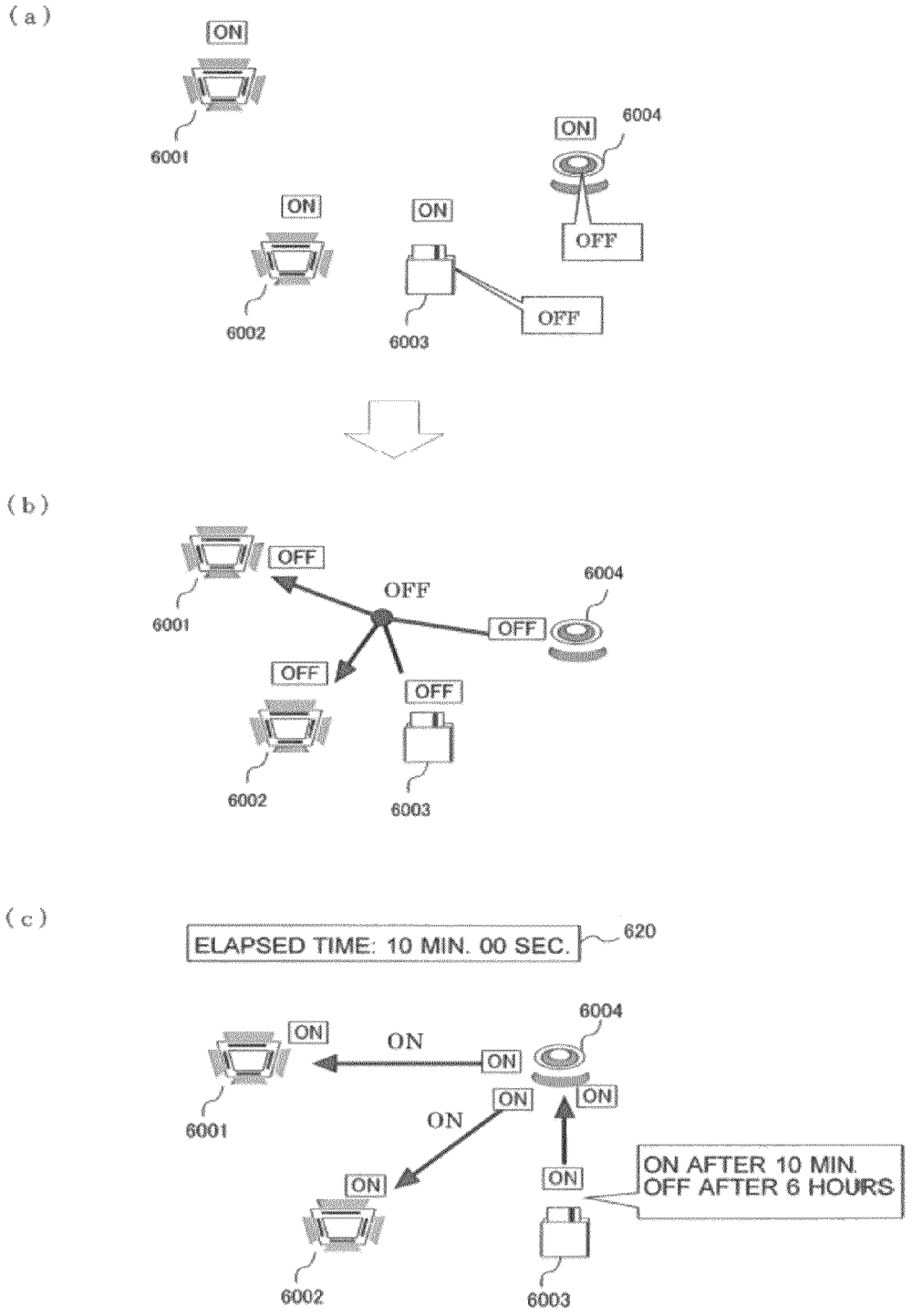
FIG. 14 is a diagram illustrating a display content of an interlocking simulation according to Embodiment 3.

FIG. 14 is a diagram illustrating a display content of the interlocking simulation according to Embodiment 3.

Referring to FIG. 14, description will be made below based on each step in FIG. 13.

Note that the operation same as above Embodiment 1 (FIG. 7) will be denoted with the same reference numeral and description will be omitted.

(S401)

The user selects, with the input device 130, the facility device(s) in which the operation status is to be changed from among the facility devices that are displayed in the layout plan 500.

(S402)

The user inputs, with the input device 130, a control that makes the selected facility device(s) be simulated.

For example, in FIG. 14(*a*), when the current operation status of facility devices 6003 and 6004 are ON, the user performs a control that switches the status of the devices to OFF.

Note that not limited to the ON/OFF switching, control may be performed to switch an arbitrary operation status such as an operation mode.

(S403)

The user inputs, with the input device 130, information on the elapsed time to simulate the control that has been input in step S402.

For example, as illustrated in FIG. 14(*c*), time periods to change the operation status is set such as turning the operation status of the facility device 6003 to ON after ten minutes and to OFF after six hours.

Note that this step may be omitted and the changing time may not be set.

(S404)

Next, the display controller 111 makes a message be displayed that confirms whether the status change of all the facility devices that is to be confirmed has been completed.

If a control is performed by the user indicating that the control has not been completed, the process returns to step S401.

On the other hand, if a control is performed by the user indicating that the control has been completed, the process proceeds to step S405.

Note that this step S404 may be omitted.

(S405)

The simulation device 120 simulates the operation of the facility devices on the basis of the input control from the input device 103, searches if there is any or some facility device after the simulation with an operation status that matches the interlock source device and the interlock condition of either of the interlock settings information 400.

If there is any or some matching interlock settings information 400, the process proceeds to step S406.

On the other hand, if there is no matching interlock settings information 400, the interlocking simulation is completed.

(S406 to S407)

The simulation device 120 starts timing the elapse of time and simulates the operation of the facility devices according to the elapsed time, on the basis of the control and the information of the elapsed time input from the input device 130.

Note that the display controller 111 makes the display of the associated facility device in the layout plan 500 be changed according to the content of the simulation operation by the control.

For example, as illustrated in FIG. 14(*c*), the elapsed time indicator 620 may display the current elapsed time.

Note that if the changing time is not set in step S403, this process is omitted.

In parallel with the subsequent operation, when the elapse of time becomes the set changing time, the simulation device 120 performs step S407 and simulates the operation status corresponding to the input control. Further, the display controller 111 makes the display of the facility devices in the layout plan 500 be changed according to the simulation operation.

(S408)

The simulation device 120 searches if there is any or some facility device after the simulation with an operation status that matches the interlock source device and the interlock condition of either of the interlock settings information 400.

If there is no matching interlock settings information 400, the process returns to step S406 and the above operation is repeated.

(S409)

On the other hand, if there is more than a piece of matching interlock settings information 400, each matching interlock settings information 400 (hereinafter, may be referred to as "interlock settings information 400 due to virtual operation") performs an interlocking simulation.

First, the display controller 111 searches for the interlock source device and the interlock destination device of the interlock settings information 400 due to virtual operation from among the facility devices displayed on the currently displayed layout plan 500.

(S410)

The display controller 111 updates the information of the layout plan 500 so as to discriminate between the display of the searched interlock source device and the interlock destination device, and the display of other facility devices. The display device 140 updates and displays the screen. The discriminating method is the same as that of above Embodiment 1.

(S208 to S210)

The interlocking simulation of the interlock settings information 400 due to virtual operation is performed with the same operation of step S208 to S210 of above Embodiment 1, and the process changing the status of the interlock source device and the interlock destination device is performed.

(S411)

The simulation device 120 determines whether the simulation operation of all of the interlock destination devices of the interlock settings information 400 due to virtual operation has been completed.

If not completed, the process returns to step S406 and the above operations are repeated.

On the other hand, if all of the simulation operations have been completed, the simulation device 120 searches if there is any or some facility device after simulation of the interlock operation with an operation status that matches the interlock source device and the interlock condition of either of the interlock settings information 400.

If there is no matching interlock settings information 400, the interlocking simulation is completed.

On the other hand, if there is more than a piece of matching interlock settings information 400, the process returns to step S409 and each matching interlock settings information 400 (hereinafter, may be referred to as "linking interlock settings information 400") performs an interlocking simulation.

As such, on the basis of the control and the information of the elapse of time input from the input device 130, the operation of the facility device can be simulated, and each time the operation status of the simulated facility device is changed, interlocking simulation of the interlock settings information 400 due to virtual operation can be performed.

For example, as illustrated in FIG. 14(*b*), by virtually controlling the operation status of the facility devices 6003 and 6004 serving as an interlock source device to OFF, the operating condition of the interlock source device of the interlock settings information 400 due to virtual operation is satisfied, and the status of the interlock destination devices 6001 and 6002 becomes OFF by the interlocking control.

As above, in Embodiment 3, an operation of a facility device is simulated on the basis of a control input from an input device 130 and simulation operation information is generated on the basis of the operation status of the simulated facility device and the interlock settings information. Further, simulation operation information is displayed in accordance with the display of the facility devices in the layout plan 500.

Accordingly, it will be possible to simulate the operation status of the facility device according to the control and to perform an interlocking simulation from the simulated operation status. Accordingly, it will be possible to change the status of the facility device to an arbitrary status and to perform interlocking simulation according to the changed content. Thus, it will be possible to easily confirm the set content of the interlocking control.

Further, on the basis of the control and the information of the elapse of time input from the input device 130, the operation of the facility device is simulated in accordance to the elapse of time, and each time the operation status of the simulated device changes, simulation operation information that has simulated the interlock operation of the facility devices is generated on the basis of the operation status of the relevant facility device and the interlock settings information. Further, simulation operation information is each displayed in accordance with the display of the facility devices in the layout plan 500.

Accordingly, it will be possible to designate a time for changing the status of the interlock device. Accordingly, it will be possible to perform the interlocking simulation in time series with a setting based on, for example, estimated behavior and past control records. Thus, it will be possible to easily confirm the set content of the interlocking control.

Embodiment 4

In Embodiment 4, an operation (hereinafter, may be referred to as "interlock confirmation") that displays on the display device 140 information indicating that an arbitrary facility device is related to an interlocking control and information on its interlock settings will be described.

In the storage device 150 of Embodiment 4, a storage area that stores information used in the operation of the interlock confirmation (hereinafter, may be referred to as "interlock list of selected device") is provided.

This "interlock list of selected device" includes a "relation as an interlock source device" storage area that stores identification information of the interlock settings information 400 in which the facility device subject to confirmation is an interlock source device and a "relation as an interlock destination device" storage area that stores identification information of the interlock settings information 400 in which the facility device subject to confirmation is an interlock destination device.

Note that in Embodiment 4, although a case in which the "interlock list of selected device" is provided in the storage device 150 is described, not limited to this case, it may be generated, during operation, in the memory or the like of the controller 110.

Note that other configurations are the same as that of Embodiment 1 and same portions will be referred to with the same reference numerals.

Figure 15:
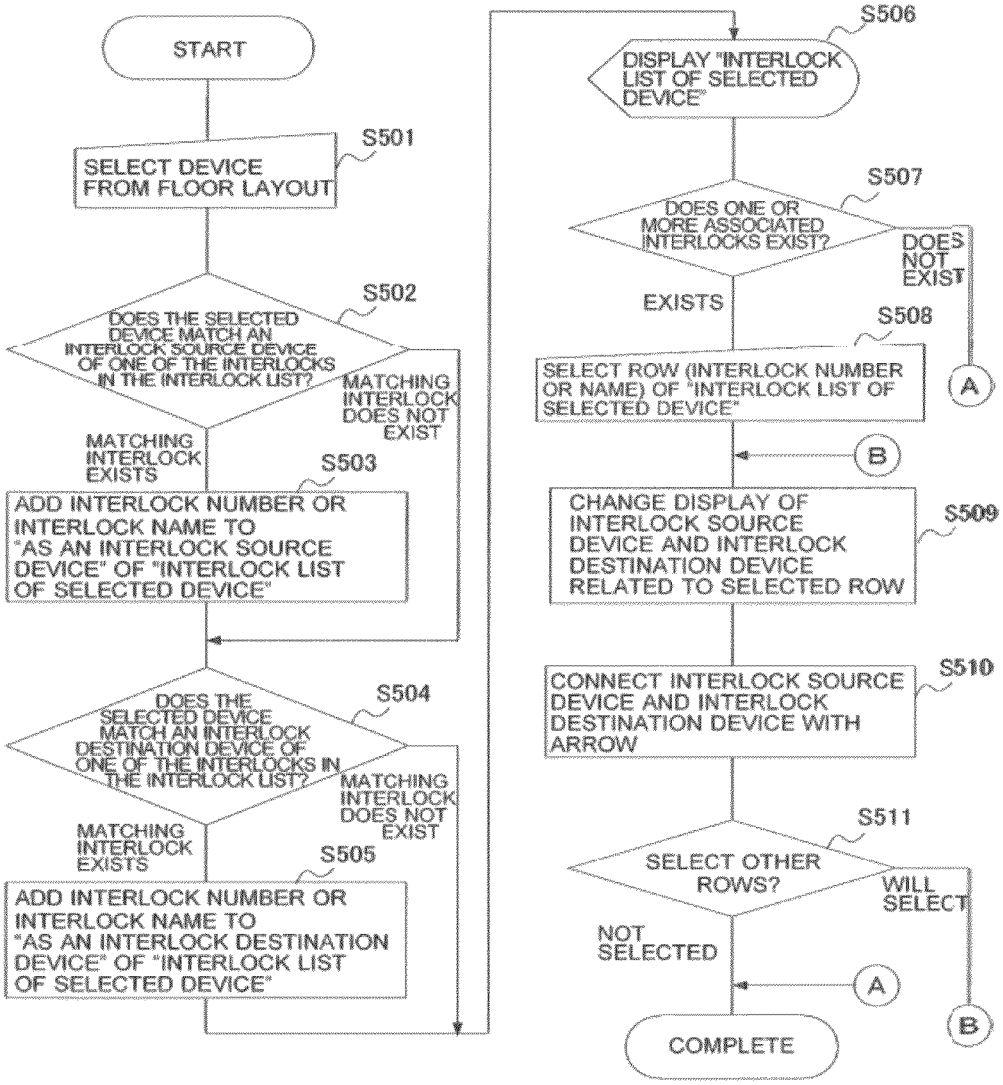
FIG. 15 is a flowchart illustrating an operation of interlock confirmation according to Embodiment 4.

FIG. 15 is a flowchart illustrating an operation of the interlock confirmation according to Embodiment 4.

Figure 16:
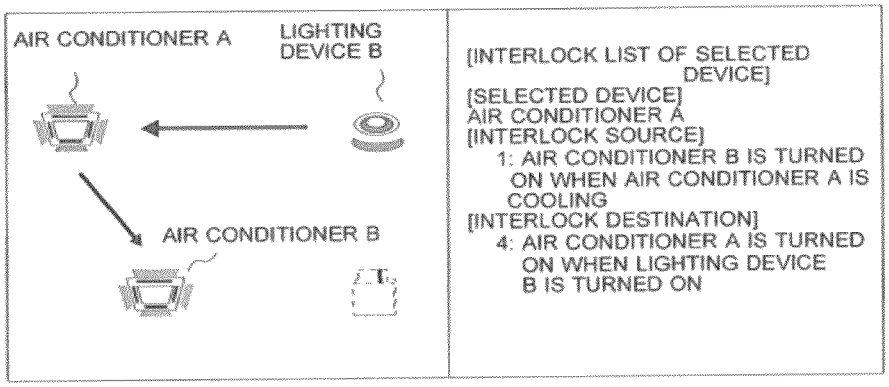
FIG. 16 is a diagram illustrating a display content of interlock confirmation according to Embodiment 4.

FIG. 16 is a diagram illustrating a display content of the interlock confirmation according to Embodiment 4.

Referring to FIG. 16, description will be made below based on each step in FIG. 15.

(S501)

The user selects, with the input device 130, the facility device(s) in which the interlock confirmation is to be performed from among the facility devices that are displayed in the layout plan 500.

(S502)

The display controller 111 searches for interlock settings information 400 in which the selected facility device(s) and the interlock source device matches each other from among the interlock settings information 400 stored in the storage device 150.

If there is no matching interlock settings information 400, the process proceeds to step S504.

(S503)

On the other hand, if there is any or some matching interlock settings information 400, the display controller 111 adds information that identifies the matched interlock settings information 400, such as the interlock number or the interlock name, to the "as an interlock source device" storage area of the "interlock list of selected device".

(S504)

Next, the display controller 111 searches for interlock settings information 400 in which the selected facility device(s) and the interlock destination device matches each other from among the interlock settings information 400 stored in the storage device 150.

If there is no matching interlock settings information 400, the process proceeds to step S506.

(S505)

On the other hand, if there is any or some matching interlock settings information 400, the display controller 111 adds information that identifies the matched interlock settings information 400, such as the interlock number or the interlock name, to the " as an interlock destination device" storage area of the "interlock list of selected device".

(S506)

The display controller 111 makes the display device 140 display information of the selected facility device(s) and information stored in the "interlock list of selected device".

With the above, identification information of the interlock settings information 400 of the interlock source device and identification information of the interlock settings information 400 of the interlock destination device are displayed as information indicating that the selected facility device(s) subject to confirmation is related to the interlocking control.

In the example shown in FIG. 16, air conditioner A is selected as the facility device subject to confirmation, and an interlock number and its name of interlock settings information 400 as an interlock source device and an interlock number and its name of interlock settings information 400 as an interlock destination device is displayed in a list.

(S507)

Next, the display controller 111 determines whether one or more pieces of information identifying the interlock settings information 400 are stored in the "interlock list of selected device". That is, whether there is any interlock settings information 400 that is in relation to the selected facility device is determined.

If there is any or some related interlock settings information 400, the process proceeds to step S508.

On the other hand, if there is no relating interlock settings information 400, the interlocking simulation is completed.

(S508)

The user selects identification information of the interlock settings information (the interlock number or its name, for example) in which its content of the interlocking control is to be confirmed from among the "interlock list of selected device" displayed on the display device 140.

(S509)

The display controller 111 updates the information of the layout plan 500 so as to discriminate between the display of the interlock source device and the interlock destination device of the selected interlock settings information 400 and the display of other facility devices. The display device 140 updates and displays the screen.

For example, as illustrated in FIG. 16, the display of the facility devices other than the interlock source device and the interlock destination device are displayed by dotted lines. Note that not limited to the above, the color may be turned pale or the icon may be deleted, for example.

With such a display, the selected facility device that is related to the interlocking control and its location can be visually understood.

(S510)

Next, the display controller 111 makes the interlock source device and the interlock destination device in the layout plan 500 be displayed with a line or an arrow connecting therebetween.

As such, the relation of the interlocking control between the facility device subject to confirmation and the interlock source device or the interlock destination device can be visually understood.

Note that at this time, the interlocking simulation of the selected interlock settings information 400 may be performed with the same operation with that of step S206 to S211 of above Embodiment 1.

(S511)

Next, the display controller 111 makes a message be displayed that confirms the user whether the selection of the interlock confirmation has been completed.

If a control is performed by the user indicating that the selection has not been completed, the process returns to step S509.

On the other hand, if a control is performed by the user indicating that the selection has been completed, the operation of the interlock confirmation is completed.

As described above, in Embodiment 4, when an arbitrary facility device among a plurality of facility devices is either an interlock source device or an interlock destination device, the display device 140 is made to display information indicating that the facility device is related to interlocking control and the interlock settings information of the facility device.

As such, the facility device that is related to the interlocking control of an arbitrary facility device and its location can be visually understood. As such, the relation of the interlocking control between the facility device subject to confirmation and the interlock source device or the interlock destination device can be visually understood. Thus, it will be possible to easily confirm the set content of the interlocking control.

Embodiment 5

In Embodiment 5, an operation estimating incorrect settings of the interlock settings information 400 will be described.

In the storage device 150 of Embodiment 5, a single or a plurality of conditions (hereinafter, referred to as "incorrect settings estimating condition") for estimating incorrect settings of the interlock settings information 400 are stored as a database.

Note that other configurations are the same as that of Embodiment 1 and same portions will be referred to with the same reference numerals.

It is preferable that the operation estimating incorrect settings is executed before performing the interlocking simulation of above Embodiments 1 to 4. This operation is to prevent an "infinite loop" that infinitely repeats a link of an interlock from occurring, for example.

[Outline of Incorrect Settings Estimation Operation]

Figure 17:
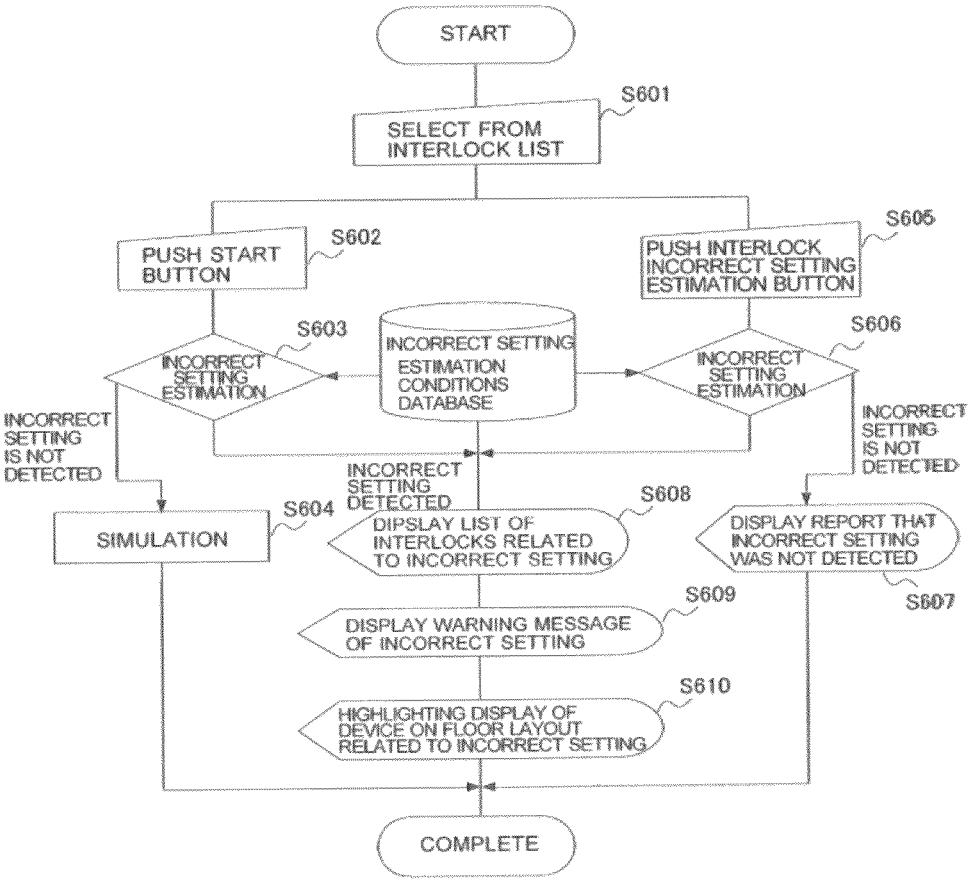
FIG. 17 is a flowchart illustrating an outline of an incorrect settings estimation operation according to Embodiment 5.

FIG. 17 is a flowchart illustrating an outline of an incorrect settings estimation operation according to Embodiment 5.

Description will be made below based on each step in FIG. 17.

First, the display controller 111 makes the initial display screen be displayed with the same operation as that of Embodiment 1 (FIG. 5).

Note that in addition to the initial screen illustrated in FIG. 6, a control button display (incorrect interlock setting estimation button) that starts the estimation operation of the incorrect settings may be displayed.

(S601)

First, the user selects a single of a plurality of interlock numbers from the interlock list 610 displayed in the initial display screen.

(S602)

The user performs a control that executes the interlocking simulation after the incorrect settings estimation operation by controlling the start button 630.

Alternatively, the user performs a control that executes the incorrect settings estimation operation by controlling the incorrect interlock setting estimation button.

(S603)

After the start button 630 is controlled, the simulation device 102 refers to the database of the incorrect settings estimating condition that is stored in the storage device 150 and determines whether there is any or some incorrect setting in the interlock settings information 400 of the selected interlock number. Details of the determination operation will be described later.

Note that when a plurality of interlock numbers are selected in step S601, the determination of whether there is any or some incorrect setting is carried out to each interlock number.

If no incorrect setting is detected, the process proceeds to step S604.

On the other hand, if an incorrect setting is detected, the process proceeds to step S608.

(S604)

The simulation device 102 and the display controller 111 executes the interlocking simulation of the selected interlock number with the same operation of either one of above Embodiments 1 to 4, and completes the operation.

(S606)

When the incorrect interlock setting estimation button is controlled in step S605, the simulation device 102 refers to the database of the incorrect settings estimating condition that is stored in the storage device 150 and determines whether there is any or some incorrect setting in the interlock settings information 400 of the selected interlock number. Details of the determination operation will be described later.

Note that when a plurality of interlock numbers are selected in step S601, the determination of whether there is any or some incorrect setting is carried out to each interlock number.

If no incorrect setting is detected, the process proceeds to step S607.

On the other hand, if an incorrect setting is detected, the process proceeds to step S608.

(S607)

The display controller 111 generates message information indicating that no incorrect setting is detected, makes the display device 140 display the message, and completes the operation.

Note that if the incorrect interlock setting estimation button is not displayed on the initial screen, above steps S605 to 607 is omitted.

(S608)

If it is determined that there is an incorrect setting in step S603 or S606, the display controller 111 generates information that identifies the interlock settings information 400 that has been determined to have an incorrect setting, such as a list of information on the interlock number or the interlock name, and makes the display device 140 display the information.

(S609)

The display controller 111 generates warning message information indicating that an incorrect setting has been detected and makes the display device 140 display the warning message.

(S610)

The display controller 111 updates the information of the layout plan 500 so as to discriminate between the display of the interlock source device and the interlock destination device of the interlock settings information 400 that has been determined to have an incorrect setting, and the display of other facility devices. The display device 140 updates and displays the screen.

In this display, highlighting is carried out such that the relevant interlock source device and interlock destination device flash in red.

Next, an explanatory operation determining whether there is an incorrect setting in above step S603 or S606 will be described.

[Infinite Loop Determination]

A description will be given on determination of an incorrect setting in which an interlocking control is infinitely repeated by the interlock (infinite loop).

Figure 18:
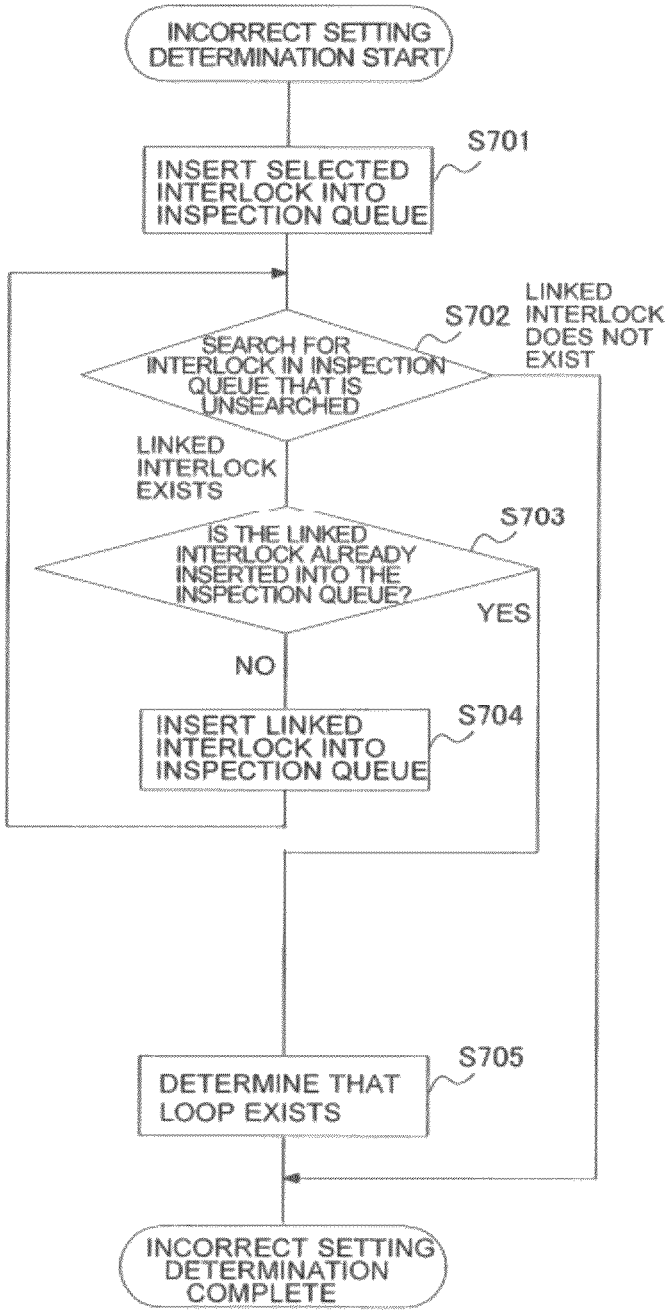
FIG. 18 is a flowchart illustrating an infinite loop determination operation according to Embodiment 5.

FIG. 18 is a flowchart illustrating an infinite loop determination operation according to Embodiment 5.

Description will be made below based on each step in FIG. 18.

(S701)

The simulation device 120 stores, in a data queue for inspection (hereinafter, referred to as "inspection queue"), information identifying the interlock settings information 400 (for example, an interlock number) that is subject to the determination of whether there is an incorrect setting.

(S702)

The simulation device 120 executes an interlocking simulation on the basis of the interlock settings information 400 subject to the determination with the same operation as that of above Embodiment 2 (FIG. 11).

Further, the simulation device 120 determines whether there is a linking interlock settings information 400 from the result of the interlock operation.

If there is no linking interlock settings information 400, it is determined that there is no incorrect setting and the incorrect setting determination operation is completed.

(S703)

On the other hand, if there is any or some linking interlock settings information 400, determination is made whether information identifying the linking interlock settings information 400 has already been inserted into the inspection queue.

If no information identifying the linking interlock settings information 400 has been inserted into the inspection queue, the process proceeds to step S704.

(S704)

The simulation device 120 inserts information identifying the relevant linking interlock settings information 400 into the inspection queue and returns to S702.

The simulation device 120 executes an interlocking simulation on the basis of the linking interlock settings information 400, and repeats the above steps.

(S705)

On the other hand, in step S703, when information identifying the relevant linking interlock settings information 400 has been inserted into the inspection queue, the simulation device 120 determines that an infinite loop has occurred, that is, if there is an overlap of the interlock settings information 400 by the link, it is determined that there is an incorrect setting.

At this time, the display controller 111 makes a warning message be displayed indicating that an infinite loop has occurred (S609).

With such an operation, it will be possible to detect an incorrect setting that infinitely repeats an interlocking control by the interlock.

Note that although an inspection queue has been employed to inspect the overlapping of the linking interlock settings information, the data structure is not limited to this and may be any that can store each piece of the linking interlock settings information 400.

[Determination of Interlock with Inconsistent Controls]

A description will be given on determination of a contradiction caused in the content of a plurality of interlock settings (interlock with inconsistent controls).

Figure 19:
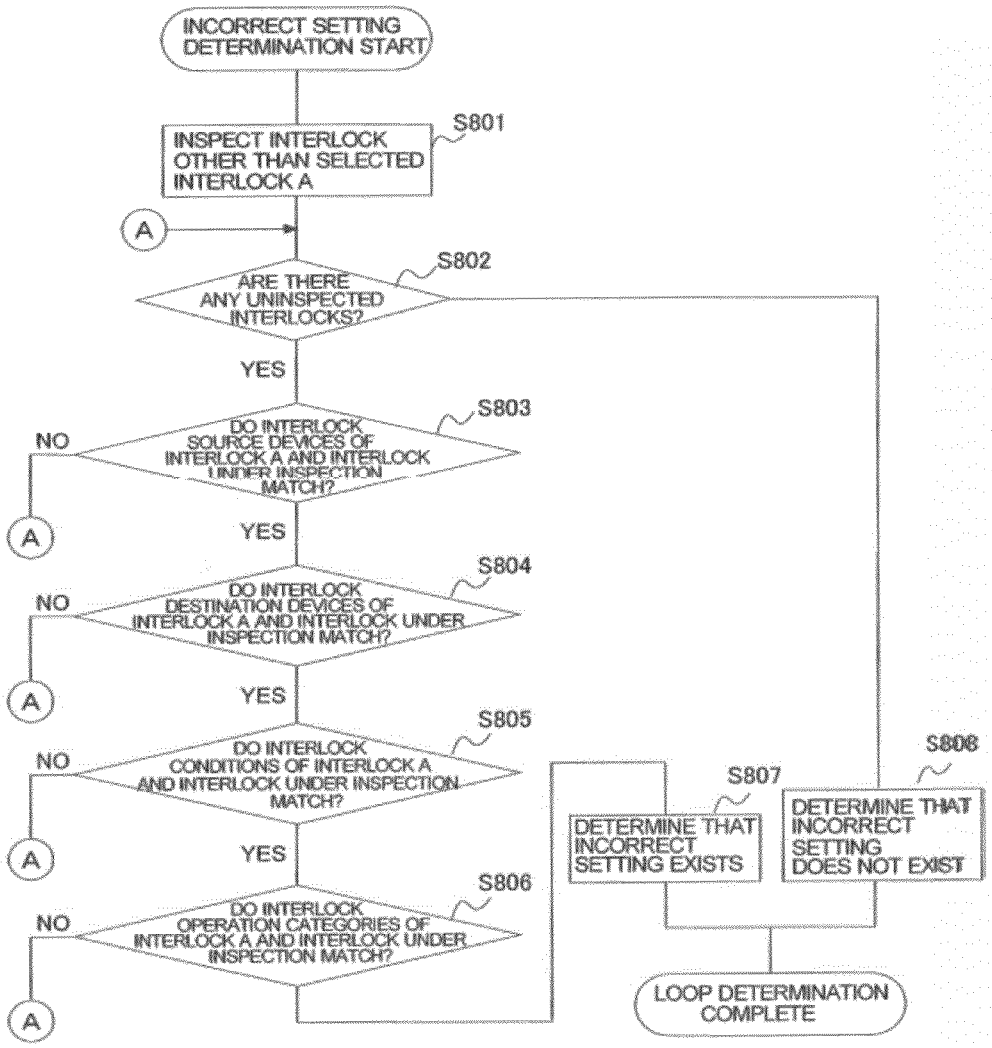
FIG. 19 is a flowchart illustrating a determination operation of an interlock with inconsistent controls.

FIG. 19 is a flowchart illustrating a determination operation of an interlock with inconsistent controls.

Figure 20:
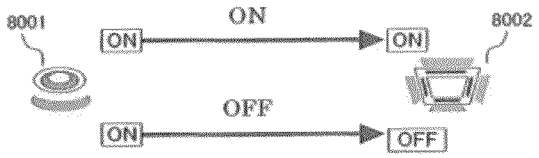
FIG. 20 is a diagram describing an interlock operation with inconsistent controls.

FIG. 20 is a diagram describing an interlock operation with inconsistent controls.

Referring to FIG. 20, description will be made below based on each step in FIG. 19.

(S801)

The simulation device 120 loads, among multiple pieces of interlock settings information 400 stored in the storage device 150, interlock settings information 400 other than the interlock settings information 400 (hereinafter, referred to as "interlock A") that is subject to the determination of whether there is an incorrect setting.

(S802)

The simulation device 120 determines whether there is an uninspected interlocking control among the loaded interlock settings information 400.

If there is any or some uninspected interlock settings information 400, the process proceeds to step S803.

On the other hand, if there is no uninspected interlock settings information 400, the process proceeds to step S808 and it is determined that there is no incorrect setting and the incorrect setting determination operation is completed.

(S803)

The simulation device 120 determines whether an interlock source device of interlock A matches an interlock source device of arbitrary interlock settings information 400 (hereinafter, referred to as "interlock under inspection") among the interlock settings information 400 that has not been inspected.

If the interlock source devices do not match, the process returns to step S802.

If the interlock source devices do match, the process proceeds to step S804.

(S804)

The simulation device 120 determines whether the interlock destination device of interlock A and the interlock destination device of the interlock under inspection match.

If the interlock destination devices do not match, the process returns to step S802.

If the interlock destination devices do match, the process proceeds to step S805.

(S805)

The simulation device 120 determines whether the interlock destination condition of interlock A and the interlock condition of the interlock under inspection matches.

If the interlock conditions do not match, the process returns to step S802.

If the interlock conditions do match, the process proceeds to step S806.

(S806)

The simulation device 120 determines whether the operation category of the interlock operation of interlock A and the interlock operation of the interlock under inspection matches.

This operation category is one in which a single operation category defines a single operation status. For example, maneuvering (operate/suspend), operation mode (cooling, heating, and the like), temperature settings, forbidding user control, and the like.

If the operation categories do not match, the process returns to step S802.

(S807)

On the other hand, if the operation categories matches, the simulation device 120 determines that an interlock with inconsistent controls has been set, that is, if there is multiple pieces of interlock settings information 400 in which the interlock source device, the interlock destination device, the interlock condition, and the category of the interlock operation match, it is determined that there is an incorrect setting.

At this time, the display controller 111 makes a warning message be displayed indicating that there is an incorrect setting (S609).

With such an operation, if there is a possibility of contradiction occurring in the contents of multiple interlock settings, it will be possible to detect it as an incorrect setting.

For example, as illustrated in FIG. 20, when there are two interlocks set in which each interlock source device 8001 and each interlock destination device 8002 are the same, and further when each interlock condition is the same, that is, when one interlock operation turns the state of the interlock destination device 8002 ON and the other interlock operation turns the state of the interlock destination device 8002 OFF, then a warning of incorrect setting is issued.

[Determination of Upper Limit of Delay Time]

A description will be given on determination of an incorrect setting in a case in which the execution time of the interlocking control exceeds a predetermined upper limit.

When the interlocking control is linked, there are cases in which the delay time becomes longer than expected by the user.

For example, due to an linking interlocking control—such as, after one hour turning a facility device A ON, one hour later turning a facility device B ON, 24 hours later turning the facility device B OFF, and one hour later turning the facility device A OFF—when an interlock control of a long period of time is executed, there is high possibility that the setting is not what the user intended to set.

As such, when the total amount of delay time exceeds a predetermined time period (time period X), it is determined that there is an incorrect setting.

Subsequently, description will be given in detail.

The simulation device 120 adds the delay time of the interlock settings information 400 and obtains the time period of the interlock operation.

Additionally, if there is linking interlock settings information 400, the relevant interlock settings information is further added to the above time period of the interlock operation.

The simulation device 120 repeats this operation until there is no linking interlock settings information 400.

The display controller 111 makes the display device 140 display a display indicating that there is an incorrect setting when the total amount of the time period of the interlock operation exceeds a predetermined time period (time period X).

Note that the predetermined time period (time period X) may be input by the control of the user or may be prestored in the storage device 150.

[Determination of Upper Limit of Number of Times of Interlock Link]

A description will be given on determination of an incorrect setting in a case in which the number of times of linking of the interlocking control exceeds a predetermined upper limit.

There is high possibility that the setting is one that the user has not intended when the number of times of linking of the interlocking control is large.

For example, there is a case in which an unintended link is created by incorrect setting between a linking interlocking control group A and a linking interlocking control group B such that the interlocking control groups A and B become a set of linked interlocking control group.

As such, when the total number of times of the linking interlocking control exceeds a predetermined number of times (N times), it is determined that there is an incorrect setting.

Subsequently, description will be given in detail.

The simulation device 120 adds the counter value that counts the number of linking times when there is linking interlock settings information 400.

The simulation device 120 repeats this operation until there is no linking interlock settings information 400.

The display controller 111 makes the display device 140 display a display indicating that there is an incorrect setting when the counter value exceeds a predetermined number of times (N times).

Note that the predetermined number of times (N times) may be input by the control of the user or may be prestored in the storage device 150.

As above, an explanatory operation determining whether there is an incorrect setting in above step S603 or S606 has been described.

Note that the determination of the incorrect setting is not limited to the above, and that an arbitrary incorrect settings estimating condition may be stored in the storage device 150.

Further, the incorrect settings estimating condition may be allowed to be input by the control input by the user.

For example, an incorrect setting estimating condition is input determining that there is an incorrect setting when the interlock operation is set to "turning the operation mode of the air conditioner to cooling" while the interlock condition is "the temperature indicator indicates 5 degrees or lower".

Additionally, for example, an incorrect settings estimating condition is input such determining that there is an incorrect setting when the interlock operation is set to "turning the operation mode of the air conditioner to heating" while the interlock condition is "the temperature indicator indicates 30 degrees or higher".

As above, in Embodiment 5, an interlock operation of facility devices is simulated on the basis of arbitrary interlock settings information among multiple pieces of interlock settings information, and if the operation status of the simulated facility device satisfies an interlock condition of another interlock settings information, the simulation of the interlock operation of the facility devices on the basis of the interlock settings information is repeated, and if there is an overlap of the interlock settings information that has simulated the interlocking operation, the display device 140 is made to display a display indicating that there is an incorrect setting.

As such, an incorrect setting that infinitely repeats an interlocking control by the interlock can be detected.

Among multiple pieces of interlock settings information, if there are multiple pieces of interlock settings information in which the interlock source devices, the interlock destination devices, and the interlock conditions match while the category of the interlock operations match, the display device 140 is made to display a display indicating that there is an incorrect setting.

Accordingly, it will be possible to detect an incorrect setting when there is a contradiction in the contents of multiple interlock settings.

Furthermore, an interlock operation of facility devices is simulated on the basis of arbitrary interlock settings information among multiple pieces of interlock settings information, and if the operation status of the simulated facility device satisfies an interlock condition of another interlock settings information, the simulation of the interlock operation of the facility devices on the basis of the interlock settings information is repeated, and if the operation time exceeds a predetermined time period or if the repeated number of times of the interlock operation exceeds a predetermined number of times, the display device 140 is made to display a display indicating that there is an incorrect setting.

Accordingly, it will be possible to detect an incorrect setting when there is a high possibility of incorrect setting in the content of the interlock setting.

Note that in addition to above Embodiments 1 to 5, the selected interlock numbers and the content of the interlock settings information 400 that has been executed by the interlocking simulation may be displayed by the display device 140.

For example, the display controller 111 may compose the interlock settings information 400 into a predetermined fixed phrase information and have the display device 140 display it.

Specifically, as a fixed phrase information, the storage device 150 may prestore "when {all/some} of {a} and {b} is {c}, then after {d} has elapsed, turn {e} and {f} into {g}".

Then information of the interlock source devices is composed with {a} {b}. The information of the interlock condition is composed with {c}. When the interlock condition is a logical product, {all} is selected and when a logical sum, {some} is selected. The information of the delay time is composed with {d}. Information of the interlock destination devices are composed with {e} {f}. The information of the interlock operation is composed with {g}.

With this, information describing the content of the interlocking control such as "when all of the air conditioner A and the air conditioner B is cooling, then after one minute has elapsed, turn air conditioner C and air conditioner D into an ON state to cooling" can be displayed on the display device 140.

Note that the fixed phrase is not limited to this and can be a fixed phrase to generate a name of the interlock, for example.

REFERENCE SIGNS LIST

10 air conditioner; 20 lighting device; 30 card key; 40 ventilating facility; 100 control system; 102 simulation device; 103 input device; 110 controller; 111 display controller; 120 simulation device; 130 input device; 140 display device; 150 storage device; 160 communication device; 200 air conditioner controller; 300 general-purpose controller; 400 interlock settings information; 510 air conditioner icon; 520 lighting device icon; 530 card key icon; 540 ventilating facility icon; 550 floor information; 610 interlock list; 620 elapsed time indicator; 630 start button; 5001 interlock source device; 5001*a* interlock source device; 5001*b* interlock source device; 5002 interlock condition; 5003 interlock destination device; 5003*a* interlock destination device; 5003*b* interlock destination device; 5004 interlock operation; 5005 connecting line; 5006 simulated status; 5010 logical product display; 5011 logical sum display; 6001 interlock destination device; 6003 facility device; 8001 interlock source device; 8002 interlock destination device.

The invention claimed is:

1. A display control system of an air conditioning system that controls an operation of a plurality of facility devices including at least an air conditioner, the control system of an air conditioning system comprising:

a storage device that stores a single or multiple of pieces of interlock settings information that is information for interlockingly control the facility devices and that stores information on a layout plan that indicates an arrangement of the facility devices in a conditioned space;

a simulation device that generates simulation operation information in which an interlock operation of the facility devices is simulated based on the interlock settings information;

a display device; and a display controller that makes the display device display the layout plan, and that makes the display device display the simulation operation information in accordance with a display of the facility devices in the layout plan; wherein the display controller causes the display device to display an indication for a displayed facility device, which is one of the facility devices in a building, when the displayed facility device serves as an interlock source device or an interlock destination device, and display another indication different from the indication for the displayed facility device when the displayed facility device does not serve as the interlock source device or the interlock destination device.

2. The display control system of an air conditioning system of claim 1, wherein the interlock settings information includes information on an interlock condition, which is information on a condition to perform an interlocking control, information on an interlocking source device that is one of the facility devices that sets the interlock condition, information on an interlock destination device that is one of the facility devices that is a subject of the interlock control, and information on the interlock operation for operating the interlock destination device when the interlock source device satisfies the interlock condition, and the display controller makes the display device display at least one of the interlock condition, the interlock source device, the interlock destination device, and the interlock operation in accordance with the display of the facility devices in the layout plan.

3. The display control system of an air conditioning system of claim 1, wherein the simulation device generates the simulation operation information based on arbitrary interlock settings information among the multiple pieces of interlock settings information, and generates simulation operation information that has simulated the interlock operation of the facility devices based on the operation status of the facility devices device, which is based on the generated simulation operation information, and other interlock settings information, and the display controller makes the display device display the generated simulation operation information in accordance with the display of the facility devices in the layout plan.

4. The display control system of an air conditioning system of claim 2, wherein the simulation device simulates the interlock operation of the facility devices based on arbitrary interlock settings information among the multiple pieces of interlock settings information, and when the operation status of a simulated facility device, which is simulated by the simulation device, satisfies an interlock condition of another interlock settings information, the simulation of the interlock operation of the facility devices on the basis of the interlock settings information is repeated.

5. The display control system of an air conditioning system of claim 1, further comprising an input device that receives a control that makes the simulation device simulate the operation of the facility devices, wherein the simulation device simulates the operation of each facility device based on the control that has received by the input device, and generates simulation operation information that has simulated the interlock operation of the facility devices based on the interlock settings information and the operation status of a simulated facility device which is simulated by the simulation device, and the display controller makes the display device display the simulation operation information in accordance with the display of the facility devices in the layout plan.

6. The display control system of an air conditioning system of claim 5, wherein the input device further receives the control that makes the simulation device simulate the operation of the facility devices and information on elapsed time to simulate the control, the simulation device simulates the operation of the facility devices in accordance with the elapsed time on the basis of the control and information on the elapsed time received by the input device, and each time the operation status of the simulated facility device, which is simulated by the simulation device, changes, the simulation device generates simulation operation information that has simulated the interlock operation of the facility devices based on the operation status of the simulated facility device and the interlock settings information, and the display controller makes the display device display the generated simulation operation information in accordance with the display of the facility devices in the layout plan.

7. The display control system of an air conditioning system of claim 2, wherein the display controller, when an arbitrary facility device among the plurality of facility devices is either the interlock source device or the interlock destination device, makes the display device display information indicating that the arbitrary facility device is related to an interlocking control and display the interlock settings information of the arbitrary facility device.

8. The display control system of an air conditioning system claim 2, wherein the simulation device simulates the interlock operation of the facility devices based on arbitrary interlock settings information among the multiple pieces of interlock settings information, and when the operation status of a simulated facility device, which is simulated by the simulation device, satisfies an interlock condition of another interlock settings information, repeats the simulation of the interlock operation of the facility devices on the basis of the interlock settings information, and the display controller makes the display device display a display indicating that there is an incorrect setting, when there is an overlap of the interlock settings information that has simulated the interlocking operation.

9. The display control system of an air conditioning system claim 2, wherein the simulation device simulates the interlock operation of the facility devices based on arbitrary interlock settings information among the multiple pieces of interlock settings information, and when the operation status of a simulated facility device, which is simulated by the simulation device, satisfies an interlock condition of another interlock settings information, repeats the simulation of the interlock operation of the facility devices on the basis of the interlock settings information, and the display controller makes the display device display a display indicating that there is an incorrect setting, when a time period of the interlock operation exceeds a predetermined time period or when a repeated number of times of the interlock operation exceeds a predetermined number of times.

10. The display control system of an air conditioning system of claim 2, wherein the display controller makes the display device display a display indicating that there is an incorrect setting, when there are, among the multiple pieces of interlock settings information, multiple pieces of interlock settings information in which the interlock source devices, the interlock destination devices, the interlock conditions, and the category of the interlock operations match each other.

11. The display control system of an air conditioning system claim 1, wherein the display controller makes the display device change the display of the facility devices in the layout plan according to the content of the simulation operation of the facility devices.

12. The display control system of an air conditioning system claim 1, wherein the display controller makes the display device display a connection between the facility devices with a line or an arrow, whose interlock operation has been simulated among the facility devices in the layout plan.

13. The display control system of an air conditioning system of claim 1, wherein the interlock settings information includes information of delay time until the interlock operation is performed after an interlock condition is satisfied, the simulation device generates the simulation operation information in which a time scale of a delayed time is changed, and the display controller makes the display device change the display of the facility devices in the layout plan according to the content of the simulation operation of the facility devices on the basis of the simulation operation information.

14. The display control system of claim 13, wherein the display controller makes the display device display a connection between an interlock source device and an interlock destination device, among the facility devices in the layout plan, with a line or an arrow and change the display of the line or the arrow in accordance with the delayed time.

15. The display control system of an air conditioning system claim 1, wherein the display controller composes the interlock settings information into a predetermined fixed phrase information and makes the display device display the composed information.

* * * * *